US011067314B2

(12) United States Patent
Matsuda et al.

(10) Patent No.: US 11,067,314 B2
(45) Date of Patent: Jul. 20, 2021

(54) REFRIGERATION CYCLE APPARATUS

(71) Applicant: Mitsubishi Electric Corporation, Tokyo (JP)

(72) Inventors: Hirofumi Matsuda, Tokyo (JP); Satoru Yanachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 161 days.

(21) Appl. No.: 16/325,203

(22) PCT Filed: Oct. 31, 2016

(86) PCT No.: PCT/JP2016/082348
§ 371 (c)(1),
(2) Date: Feb. 13, 2019

(87) PCT Pub. No.: WO2018/078883
PCT Pub. Date: May 3, 2018

(65) Prior Publication Data

US 2019/0242622 A1 Aug. 8, 2019

(51) Int. Cl.
*F25B 1/04* (2006.01)
*F25B 43/02* (2006.01)
(Continued)

(52) U.S. Cl.
CPC ..... *F25B 1/04* (2013.01); *F25B 31/004* (2013.01); *F25B 43/02* (2013.01); *F25B 49/02* (2013.01);
(Continued)

(58) Field of Classification Search
CPC ..... F25B 1/04; F25B 31/004; F25B 43/02; F25B 2400/02; F25B 2400/23;
(Continued)

(56) References Cited

U.S. PATENT DOCUMENTS 3,283,532 A 11/1966 Kocher
3,939,470 A * 2/1976 Arai ..... F01M 11/12 340/450
8,353,180 B2 * 1/2013 Okamoto ..... F25B 43/02 62/470

FOREIGN PATENT DOCUMENTS

JP H01-302072 A 12/1989
JP H03-73880 U 7/1991
(Continued)

OTHER PUBLICATIONS

Office Action dated Jun. 11, 2020 issued in corresponding CN patent application No. 201680089837.5 (and English translation).
(Continued)

*Primary Examiner* — Joseph F Trpisovsky
(74) *Attorney, Agent, or Firm* — Posz Law Group, PLC

(57) ABSTRACT

A refrigeration cycle apparatus refrigeration cycle apparatus in which refrigerant circulates in an order of a compressor, an oil separator, a condenser, an expansion valve, an evaporator, and an accumulator. The refrigeration cycle apparatus includes: an oil returning path extending from the oil separator to the compressor; a first electromagnetic valve provided on the oil returning path; an oil returning path extending from the accumulator to the compressor; a second electromagnetic valve provided on the oil returning path; and a controller configured to control a degree of opening of the first electromagnetic valve and a degree of opening of the second electromagnetic valve.

3 Claims, 25 Drawing Sheets

(51) Int. Cl.
*F25B 49/02* (2006.01)
*F25B 31/00* (2006.01)

(52) U.S. Cl.
CPC ..... *F25B 2400/02* (2013.01); *F25B 2400/23* (2013.01); *F25B 2500/16* (2013.01); *F25B 2600/2519* (2013.01); *F25B 2700/03* (2013.01)

(58) Field of Classification Search
CPC ..... F25B 2700/03; F25B 2500/16; F25B 2600/2519; F25B 49/02
See application file for complete search history.

(56) References Cited

FOREIGN PATENT DOCUMENTS

| | | | |
|---|---|---|---|
| JP | H03-127165 | U | 12/1991 |
| JP | 2001-012351 | A | 1/2001 |
| JP | 2003-028523 | A | 1/2003 |
| JP | 2003-279175 | A | 10/2003 |
| JP | 3937884 | B2 | 4/2007 |
| JP | 2014-145554 | A | 8/2014 |
| JP | 2014-181869 | A | 9/2014 |

OTHER PUBLICATIONS

Office Action dated Jan. 7, 2020 issued in corresponding JP patent application No. 2018-547101 (and English translation).
Extended European Search Report dated Aug. 21, 2019 issued in corresponding EP patent application No. 16919754.8.
International Search Report of the International Searching Authority dated Jan. 17, 2017 for the corresponding International application No. PCT/JP2016/082348 (and English translation).
Office Action dated Feb. 10, 2021 issued in corresponding CN patent application No. 201680089837.5 (and English translation).

* cited by examiner

REFRIGERATION CYCLE APPARATUS

CROSS REFERENCE TO RELATED APPLICATION

This application is a U.S. national stage application PCT/JP2016/082348 filed on Oct. 31, 2016, the contents of which are incorporated herein by reference.

TECHNICAL FIELD

The present invention relates to a refrigeration cycle apparatus having an oil returning path.

BACKGROUND ART

Conventionally, in an refrigeration cycle apparatus including a compressor, a condenser, an expansion valve, and an evaporator, an oil separator is provided at the discharge side of the compressor because refrigeration oil is discharged from the compressor together with refrigerant. In order to prevent oil shortage in the compressor, an oil returning path is provided to return, to the suction side of the compressor, the refrigeration oil separated from the refrigerant in the oil separator. By opening and closing an on-off valve on the oil returning path, an amount of oil in the compressor is adjusted (for example, see Japanese Utility Model Laying-Open No. 3-73880 (Patent Literature 1)).

CITATION LIST

Patent Literature

PTL 1: Japanese Utility Model Laying-Open No. 3-73880

SUMMARY OF INVENTION

Technical Problem

In the refrigerant circuit described in Japanese Utility Model Laying-Open No. 3-73880, the opening and closing of the on-off valve on the oil returning path are controlled based on time. However, in this method, since a precise amount of oil cannot be checked, the on-off valve is open even after completion of the returning of the refrigeration oil into a container, with the result that not only the refrigeration oil but also the refrigerant are returned to the compressor. Accordingly, it is expected that refrigerator performance is decreased due to a decreased flow rate of the refrigerant to the evaporator and that controllability of an internal temperature of the refrigerator is deteriorated due to a frequency change of the compressor. Moreover, when an excess of oil is returned, a motor of the compressor is soaked in the oil, thus resulting in such a concern that the volume efficiency of the compressor is decreased.

The present invention has been made to solve the above-described problem, and has an object to not only protect a compressor but also prevent decreased performances of the compressor and a refrigeration cycle apparatus by accurately detecting an oil level using a sensor so as to precisely return oil to a container of the compressor.

Solution to Problem

A refrigeration cycle apparatus according to a main aspect is a refrigeration cycle apparatus in which refrigerant circulates in an order of a compressor, a first oil separator, a condenser, an expansion valve, an evaporator, and a second oil separator. The refrigeration cycle apparatus includes: a first bypass path extending from the first oil separator to the compressor; a first on-off valve provided on the first bypass path; a second bypass path extending from the second oil separator to the compressor; a second on-off valve provided on the second bypass path; and a controller configured to control a degree of opening of the first on-off valve and a degree of opening of the second on-off valve.

Advantageous Effects of Invention

Reliability of the refrigeration cycle apparatus according to the present invention for preventing oil shortage in the compressor can be improved by controlling the degrees of opening of the first on-off valve and the second on-off valve by the controller so as to precisely adjust an amount of returning of the oil.

DESCRIPTION OF EMBODIMENTS

Figure 1:
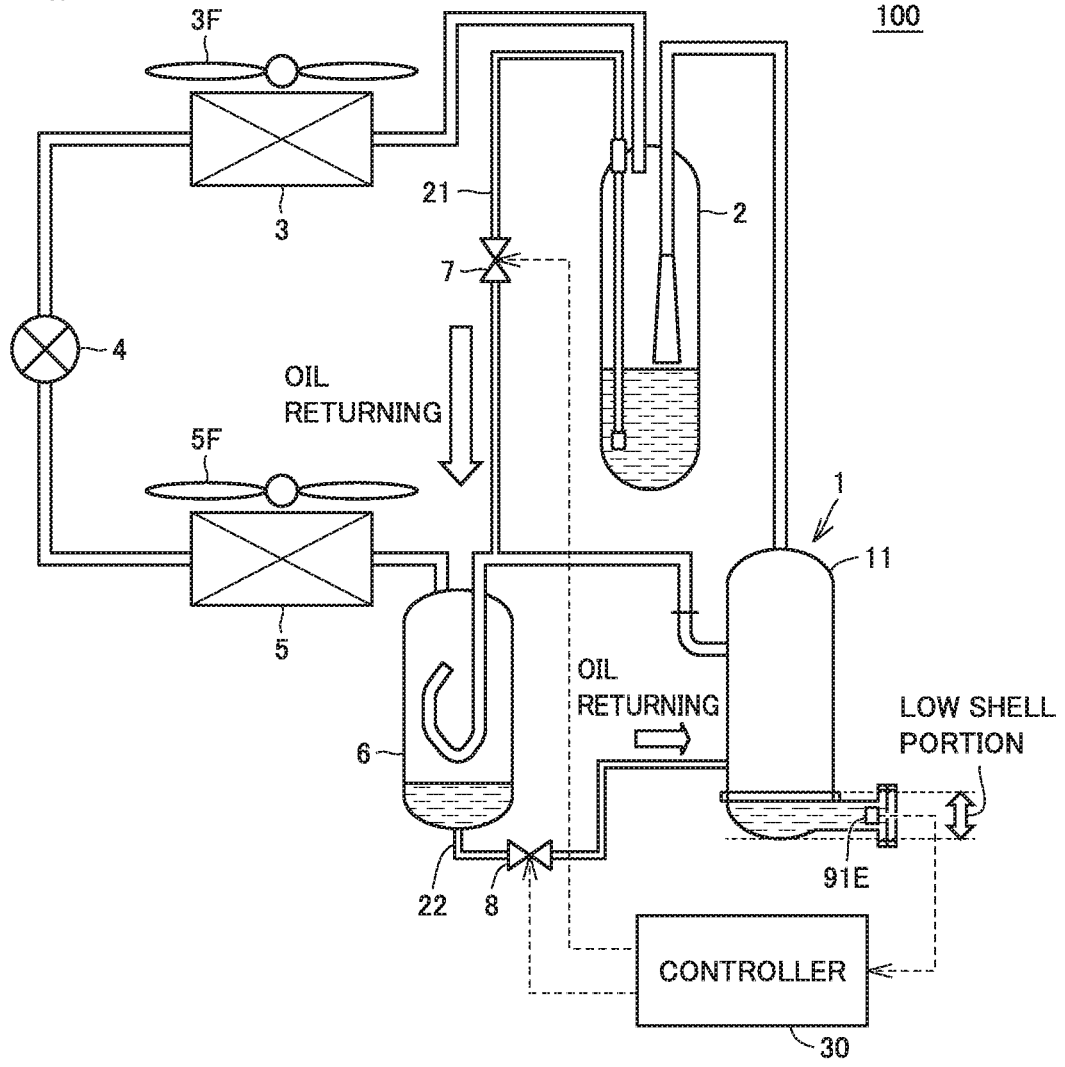
FIG. 1 is an entire configuration diagram of a refrigeration cycle apparatus according to a first embodiment.

The following describes an embodiment of the present invention in detail with reference to figures. In the description below, a plurality of embodiments will be described; however, it is initially expected at the time of filing of the present application to appropriately combine configurations described in the embodiments. It should be noted that the same or corresponding portions are given the same reference characters and are not described repeatedly.

First Embodiment

FIG. 1 is an entire configuration diagram of a refrigeration cycle apparatus according to a first embodiment. With reference to FIG. 1, refrigeration cycle apparatus 100 includes a compressor 1, an oil separator 2, a condenser 3, an expansion valve 4, an evaporator 5, an accumulator 6, and a controller 30.

Compressor 1, oil separator 2, condenser 3, expansion valve 4, evaporator 5, and accumulator 6 are connected in this order, thus forming a refrigerant circuit. Each of oil separator 2 and accumulator 6 also operates as an "oil separator". In addition to the refrigerant circuit, refrigeration cycle apparatus 100 is provided with oil returning paths 21, 22 for returning refrigeration oil to compressor 1. Although not shown in the figure, each of oil returning paths 21, 22 includes a capillary tube for reducing a flow rate. Electromagnetic valves 7, 8 are disposed on oil returning paths 21, 22, respectively. It should be noted that each of electromagnetic valves 7, 8 does not need to be an electromagnetic valve as long as a degree of opening thereof can be changed, and may be an on-off valve that can include an electronically controlled valve, an electrically operated valve, or the like. Oil separator 2 and accumulator 6 are connected to compressor 1 via oil returning paths 21, 22. Electromagnetic valves 7, 8 are disposed on oil returning paths 21, 22. A self-heating sensor 91E configured to detect an amount of lubricating oil is attached to a low shell portion of compressor 1 corresponding to a limit of height with which reliability can be secured from oil shortage. The low shell portion can be, for example, substantially as high as an oil suction hole of an oil pump in such a configuration that the refrigeration oil is suctioned using the oil pump and is supplied to a motor in the compressor or a sliding portion of a scroll compressor. Moreover, compressor 1 has a shape obtained by combining curved upper arm portion and lower arm portion with a straight shell portion that connects the upper arm portion to the lower arm portion. The low shell portion may correspond to the lower arm portion.

The following first describes an operation of refrigeration cycle apparatus 100. The refrigerant is compressed by compressor 1 and becomes a high-temperature and high-pressure overheated gas. In condenser 3, heat exchange is performed between the refrigerant and external air, and the refrigerant becomes a high-pressure saturated liquid. The refrigerant is decompressed when passing through expansion valve 4. Internal air of the refrigerator is supplied to evaporator 5 by an evaporator fan 5F to exchange heat with the refrigerant, with the result that the refrigerant becomes a low-pressure saturated gas or overheated gas. Then, in accumulator 6, the liquid refrigerant is separated from the gas refrigerant, and the gas refrigerant is supplied to compressor 1.

Compressor 1 includes a casing 11, a motor, and a scroll compressor. In casing 11, motor and scroll compressor driven to rotate by motor are accommodated. The refrigerant is compressed by scroll compressor and is discharged from compressor 1. Compressor 1 may include a rotary compressor instead of scroll compressor.

Next, the following describes flows of the refrigerant and the refrigeration oil. The discharged mixture of the high-temperature and high-pressure refrigerant and the refrigeration oil from compressor 1 flows into oil separator 2, and the refrigerant and the refrigeration oil are roughly separated due to actions of centrifugal separation, gravity, filter, and the like. Since the refrigeration oil is separated by oil separator 2, it is possible to suppress decrease in heat transfer performance due to mixing of the refrigeration oil, and suppress decrease in cycle performance due to increase in pressure loss. Moreover, when self-heating sensor 91E disposed in compressor 1 detects insufficiency of the refrigeration oil, the refrigeration oil separated by oil separator 2 is supplied to compressor 1 by opening electromagnetic valve 7 on oil returning path 21. It should be noted that the refrigeration oil that could not have been separated from the refrigerant in oil separator 2 is returned to compressor 1 via condenser 3, expansion valve 4, evaporator 5, and accumulator 6. On this occasion, in order to prevent a liquid-back phenomenon, the refrigeration oil is also separated, together with the liquid refrigerant, from the gas refrigerant by accumulator 6.

Next, the following describes a situation in which the amount of oil in the compressor is decreased. When the mixture of the refrigerant and the refrigeration oil is returned to compressor 1 via condenser 3, expansion valve 4, and evaporator 5, the moving speed of the refrigeration oil is slower than the moving speed of the refrigerant, with the result that the refrigeration oil exists to be accumulated in a pipe and the like. When components of one refrigerant circuit are connected by a long pipe, such accumulation is noticeable.

In consideration of such a situation, an amount of oil introduced in refrigeration cycle apparatus 100 has to be large. However, if the refrigeration oil in the refrigerant can be separated by oil separator 2, a circulation ratio of the refrigeration oil to the refrigerant becomes low, whereby the length of the connecting pipe does not much affect decrease in the amount of oil in compressor 1 (=increase in the amount of introduced oil).

Conversely, it is said that a case where a capability of separating the refrigeration oil in oil separator 2 is exceeded corresponds to the situation in which the amount of oil in compressor 1 is decreased. Particularly, the case corresponds to a situation in which the liquid refrigerant and the refrigeration oil exist in compressor 1, the liquid refrigerant is abruptly foamed (evaporated), and refrigerant solubility of the refrigeration oil is abruptly decreased. In this case, a large amount of the refrigeration oil in the compressor shell is released from compressor 1 together with the refrigerant. Accordingly, they cannot be separated by oil separator 2 and are returned to compressor 1 via condenser 3, expansion valve 4, and evaporator 5. When the amount of decrease in the amount of the oil in compressor 1 is large by the time at which the large amount of the discharged refrigeration oil is returned, reliability is decreased such as insufficient lubrication of compressor 1.

(Explanation of Sensor)

Figure 2:
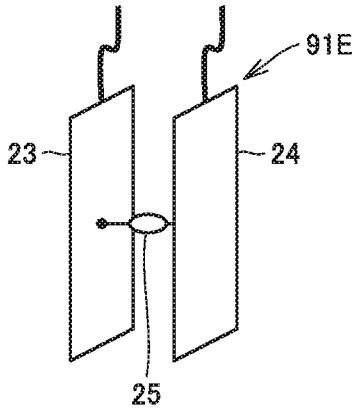
FIG. 2 shows a configuration of a self-heating sensor.

In the present embodiment, self-heating sensor 91E is disposed at the low shell portion of the compressor in order to accurately ascertain the amount of decrease in the amount of the oil in compressor 1. The following describes a method for detecting an oil level using this self-heating sensor 91E. FIG. 2 shows a configuration of the self-heating sensor. Self-heating sensor 91E is a sensor configured to distinguish between gas and liquid by measuring a response when the sensor is supplied with electric power to generate heat. Self-heating sensor 91E is constituted of two electrodes 23, 24 and an element 25 having an electric resistance that changes depending on a temperature. Element 25 is disposed between two electrodes 23, 24. A fluid state (gas/liquid) at any position inside the oil separator can be determined in accordance with an environmental temperature Tatm measured by a temperature sensor (not shown) and an electrical signal obtained by supplying electric power to self-heating sensor 91E.

Figure 3:
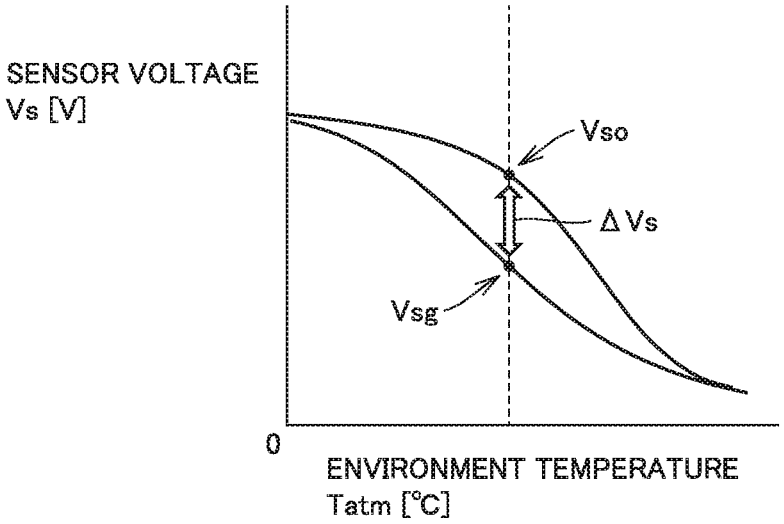
FIG. 3 shows characteristics of the self-heating sensor.

FIG. 3 shows characteristics of the self-heating sensor. Self-heating sensor 91E generates heat when supplied with electric power. On this occasion, an amount of released heat is changed depending on (i) a difference in heat transfer rate determined by a state (gas/liquid) of the fluid in contact with the sensor and (ii) a difference in environmental temperature Tatm. Accordingly, the temperature of self-heating sensor 91E is also changed, thus resulting in a difference in sensor voltage depending on the state (gas/liquid) of the fluid.

At each environmental temperature, there is a voltage difference ΔVs between (i) voltage Vso (hereinafter, referred to as "oil voltage") when the sensor is soaked in the refrigeration oil and (ii) voltage Vsg (hereinafter, referred to as "gas voltage") when the sensor is in the gas. By measuring the sensor temperature as a voltage value, whether the fluid in contact therewith is gas or liquid (oil) can be detected. A threshold value range for gas voltage Vsg is determined based on sensor voltage difference ΔVs at each temperature. When the voltage is increased by more than or equal to the threshold value range in such a state that gas voltage Vsg has been detected during monitoring of a change of the sensor voltage with passage of time, it can be determined that the oil is detected. Similarly, based on sensor voltage difference ΔVs at each temperature, a threshold value range for oil voltage Vso is determined. When the voltage is decreased by more than or equal to the threshold value range in such a state that oil voltage Vso has been detected during monitoring of a change of the sensor voltage with passage of time, it can be determined that the gas is detected. It should be noted that a self-heating sensor used in each of below-described second to twelfth embodiments also has such characteristics as shown in FIG. 3.

(Explanation of Oil Returning Control)

Figure 4:
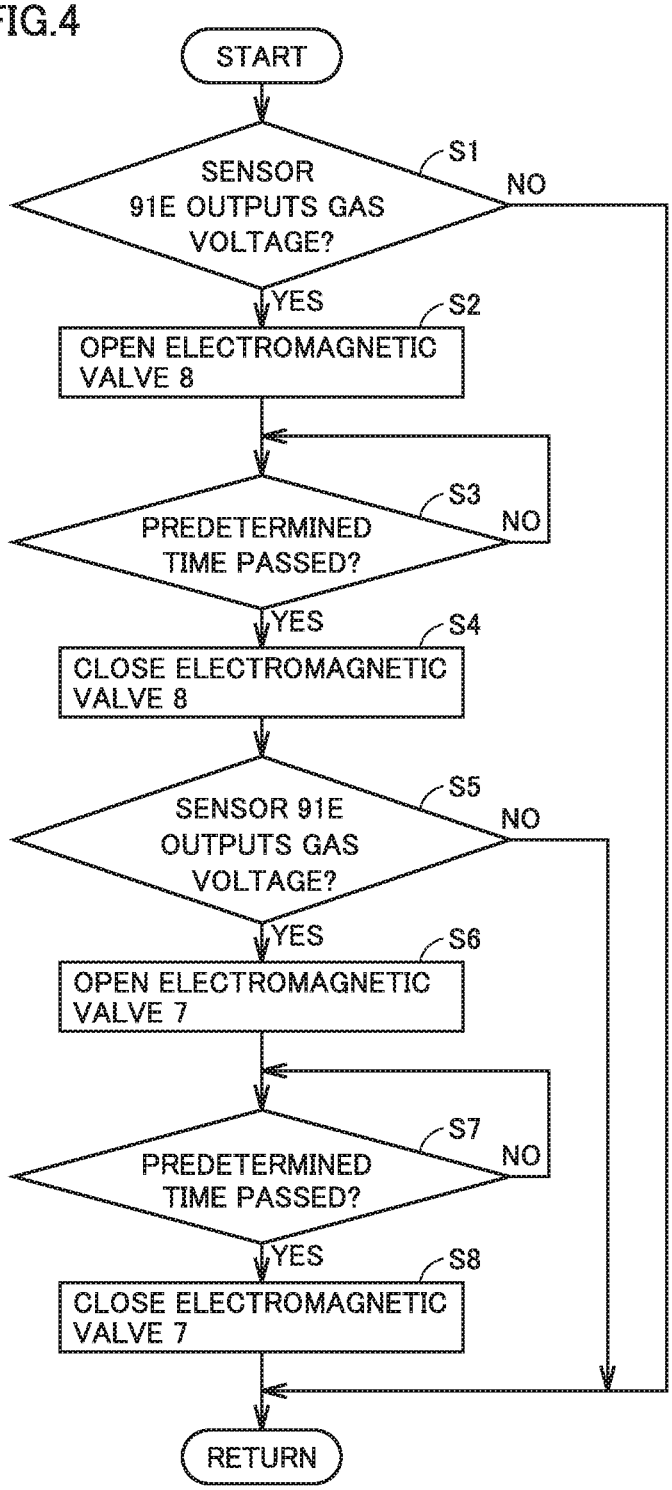
FIG. 4 is a flowchart for illustrating oil returning control in the first embodiment.

Next, the following describes oil returning control. FIG. 4 is a flowchart for illustrating the oil returning control in the first embodiment. With reference to FIG. 1 and FIG. 4, controller 30 obtains a voltage value from self-heating sensor 91E in compressor 1. In a step S1, controller 30 determines whether or not the obtained voltage value indicates gas voltage Vsg. When the voltage value obtained in step S1 indicates gas voltage Vsg, compressor 1 is in an oil shortage state. Therefore, controller 30 proceeds the process to a step S2 to open electromagnetic valve 8 on the oil returning path. When electromagnetic valve 8 is opened, the refrigeration oil is returned from accumulator 6 to compressor 1. After waiting for passage of a predetermined time in a step S3, controller 30 proceeds the process to a step S4 to close electromagnetic valve 8. Then, in a step S5, controller 30 obtains a voltage value from self-heating sensor 91E in compressor 1, and determines whether or not the obtained voltage value indicates gas voltage Vsg of FIG. 3.

When the output of sensor 91E indicates gas voltage Vsg at this point of time in step S5, the oil shortage state of compressor 1 is still continued. Hence, in order to compensate for the insufficiency of the refrigeration oil, controller 30 proceeds the process to a step S6 to open electromagnetic valve 7, thereby starting to return the oil from oil separator 2. Then, after waiting for passage of a predetermined time in a step S7, controller 30 closes electromagnetic valve 7 in a step S8 to end the oil returning.

In the above-described control, the oil is returned from accumulator 6 located at a downstream side of the refrigerant circuit and then the oil is returned, if the amount of the oil is insufficient, from the oil separator located at the upstream side. This is due to the following reason: since the pressure of oil separator 2 at the upstream side is higher than that of accumulator 6, energy loss can be reduced by returning the oil from accumulator 6 first.

Further, the oil level can be detected without an influence of the flow of the refrigerant because self-heating sensor 91E is attached and mounted on the container using the parallel electrodes, i.e., because element 25 is disposed between two electrodes 23 and 24 disposed in parallel.

Second Embodiment

In the first embodiment, the oil level in compressor 1 is detected and the refrigeration oil is returned from oil separator 2 and accumulator 6; however, in a second embodiment below, the following describes an example in which oil returning control is performed when one self-heating sensor is attached in oil separator 2.

Figure 5:
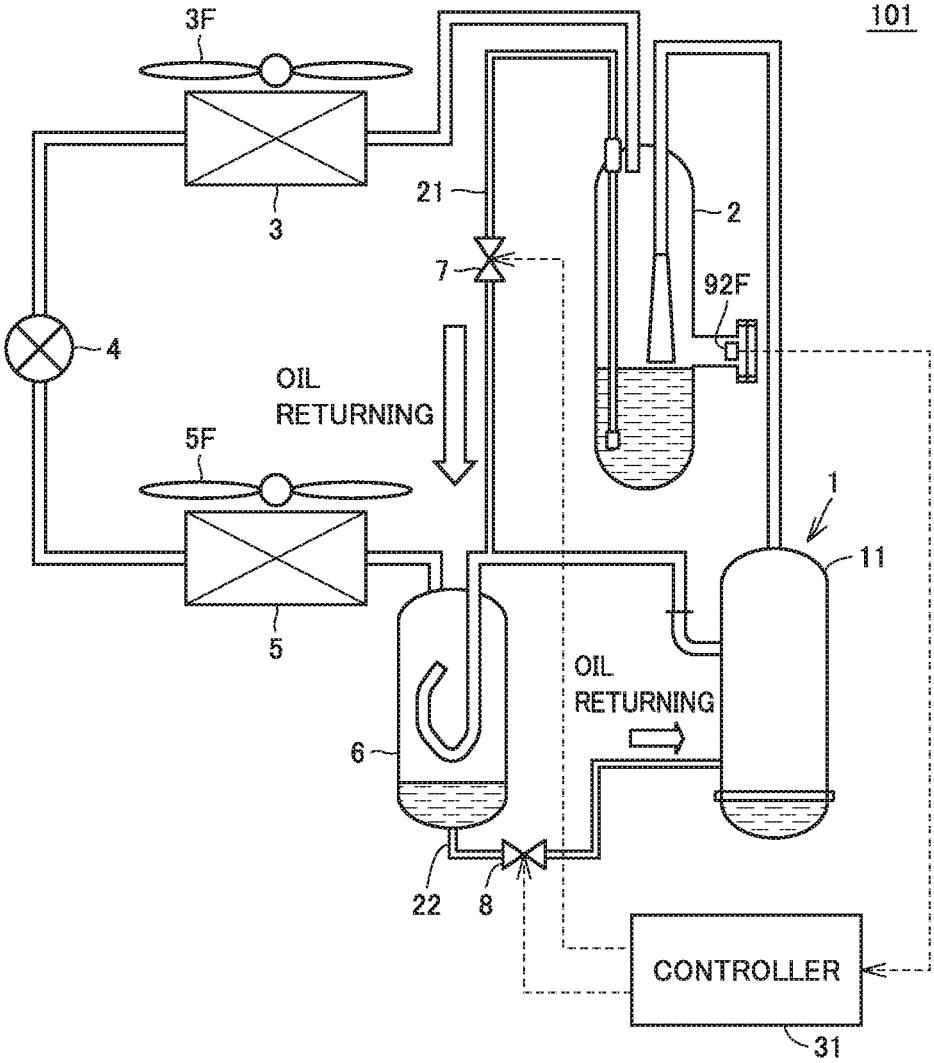
FIG. 5 is an entire configuration diagram of a refrigeration cycle apparatus according to a second embodiment.

FIG. 5 is an entire configuration diagram of a refrigeration cycle apparatus according to the second embodiment. Refrigeration cycle apparatus 101 of FIG. 5 includes a sensor 92F instead of sensor 91E and a controller 31 instead of controller 30 in the configuration of refrigeration cycle apparatus 100 shown in FIG. 1. Configurations of the other portions of refrigeration cycle apparatus 101 are the same as those of refrigeration cycle apparatus 100. Moreover, the configuration and characteristics of sensor 92F are the same as those of sensor 91E shown in FIG. 2 and FIG. 3.

Refrigeration cycle apparatus 101 of FIG. 5 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. One self-heating sensor 92F is attached to oil separator 2.

From the oil-mixed refrigerant discharged from compressor 1, the refrigeration oil and the refrigerant are separated by a separation mechanism of oil separator 2. The separated refrigeration oil is stored at the bottom portion of the casing of oil separator 2.

Figure 6:
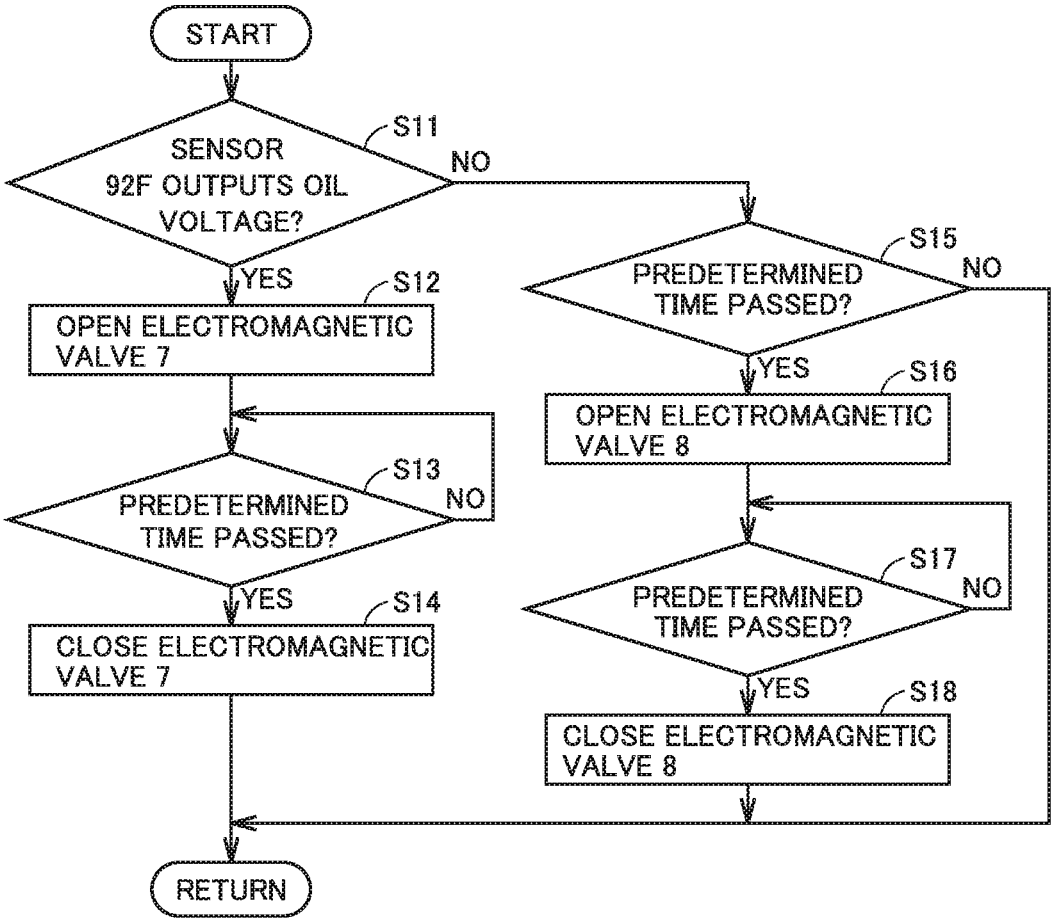
FIG. 6 is a flowchart for illustrating oil returning control in the second embodiment.

FIG. 6 is a flowchart for illustrating oil returning control in the second embodiment. Hereinafter, a "step S11" or the like will be simply described as "S11" or the like. When self-heating sensor 92F in oil separator 2 is soaked in the refrigeration oil as a result of accumulation of the refrigeration oil with passage of time and the output of self-heating sensor 92F indicates oil voltage Vso (YES in S11), it is understood that compressor 1 is in the oil shortage state because the amount of accumulation of the refrigeration oil in oil separator 2 has been increased. Then, controller 31 opens electromagnetic valve 7 disposed on oil returning path 21 that connects oil separator 2 to compressor 1 (S12), thereby starting to return the oil from oil separator 2 to compressor 1. Then, controller 31 waits (NO in S13) for passage of a predetermined time calculated in consideration of an amount of oil brought out from compressor 1, the oil separation efficiency of oil separator 2, and the volume of each portion in the refrigerant circuit. After passage of the predetermined time (YES in S13), controller 31 closes electromagnetic valve 7 (S14) to end the oil returning.

Moreover, when the output of sensor 92F does not indicate oil voltage Vso (NO in S11), after passage of a predetermined time (YES in S15), controller 31 opens electromagnetic valve 8 to actively start returning the oil from accumulator 6 to compressor 1 (S16). In this way, the oil is returned to compressor 1 whenever at least the predetermined time passes, thus preventing the amount of accumulation of the oil in accumulator 6 from being increased too much. Then, controller 31 waits for passage of a predetermined time (NO in S17). After passage of the predetermined time (YES in S17), controller 31 closes electromagnetic valve 8 (S18), thereby ending the oil returning.

Third Embodiment

Figure 7:
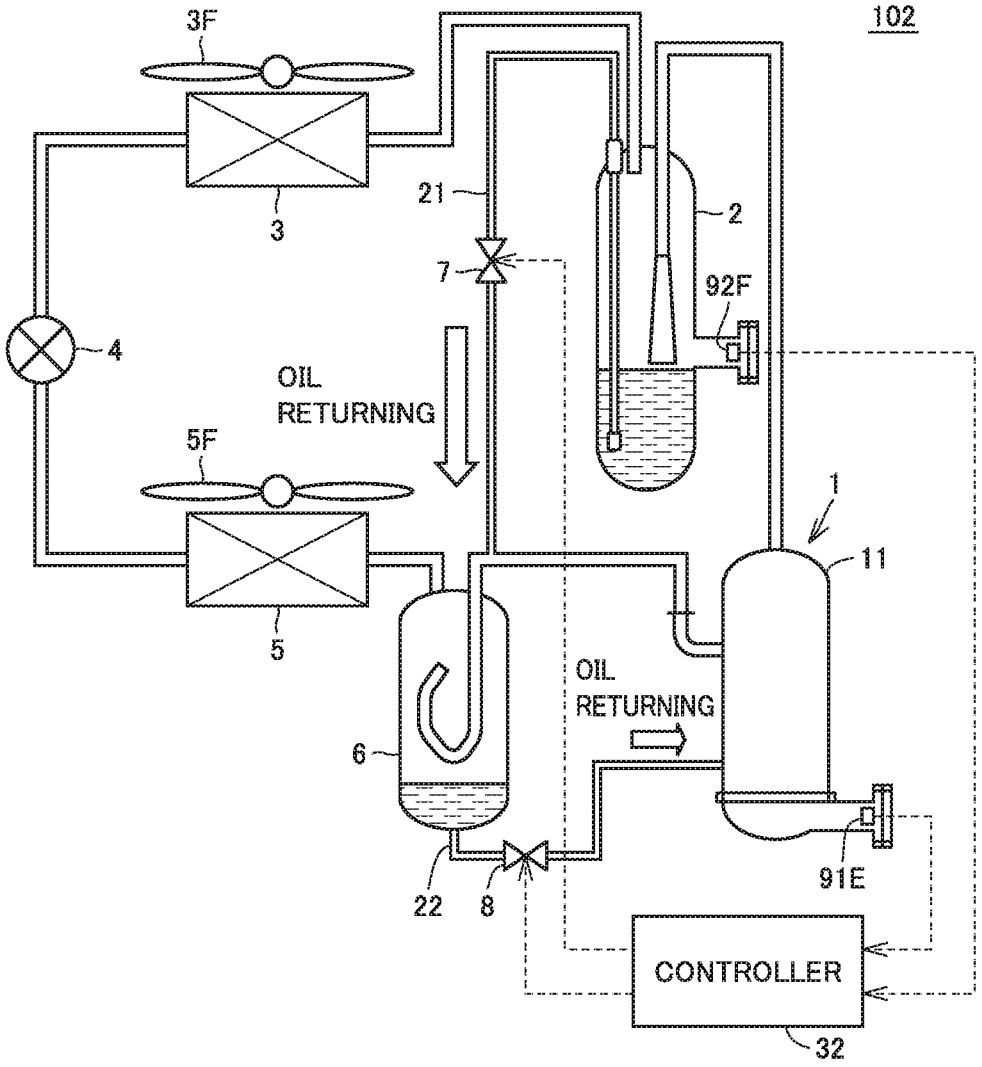
FIG. 7 is an entire configuration diagram of a refrigeration cycle apparatus according to a third embodiment.

FIG. 7 is an entire configuration diagram of a refrigeration cycle apparatus according to a third embodiment. A refrigeration cycle apparatus 102 shown in FIG. 7 performs oil returning control in a manner in which the first embodiment and the second embodiment are combined. Refrigeration cycle apparatus 102 of FIG. 7 includes a sensor 92F in addition to sensor 91E and a controller 32 instead of controller 30 in the configuration of refrigeration cycle apparatus 100 shown in FIG. 1. Refrigeration cycle apparatus 102 includes self-heating sensors 91E, 92F respectively attached to compressor 1 and oil separator 2. Refrigeration cycle apparatus 102 includes a refrigerant circuit in which compressor 1, oil separator 2, condenser 3, expansion valve 4, evaporator 5, and accumulator 6 are connected in this order. Oil separator 2 and accumulator 6 are connected to the compressor via oil returning paths 21, 22. Electromagnetic valves 7, 8 are disposed on oil returning paths 21, 22 respectively. Self-heating sensor 91E is attached to the low shell portion of compressor 1, and self-heating sensor 92F is attached to oil separator 2.

Figure 8:
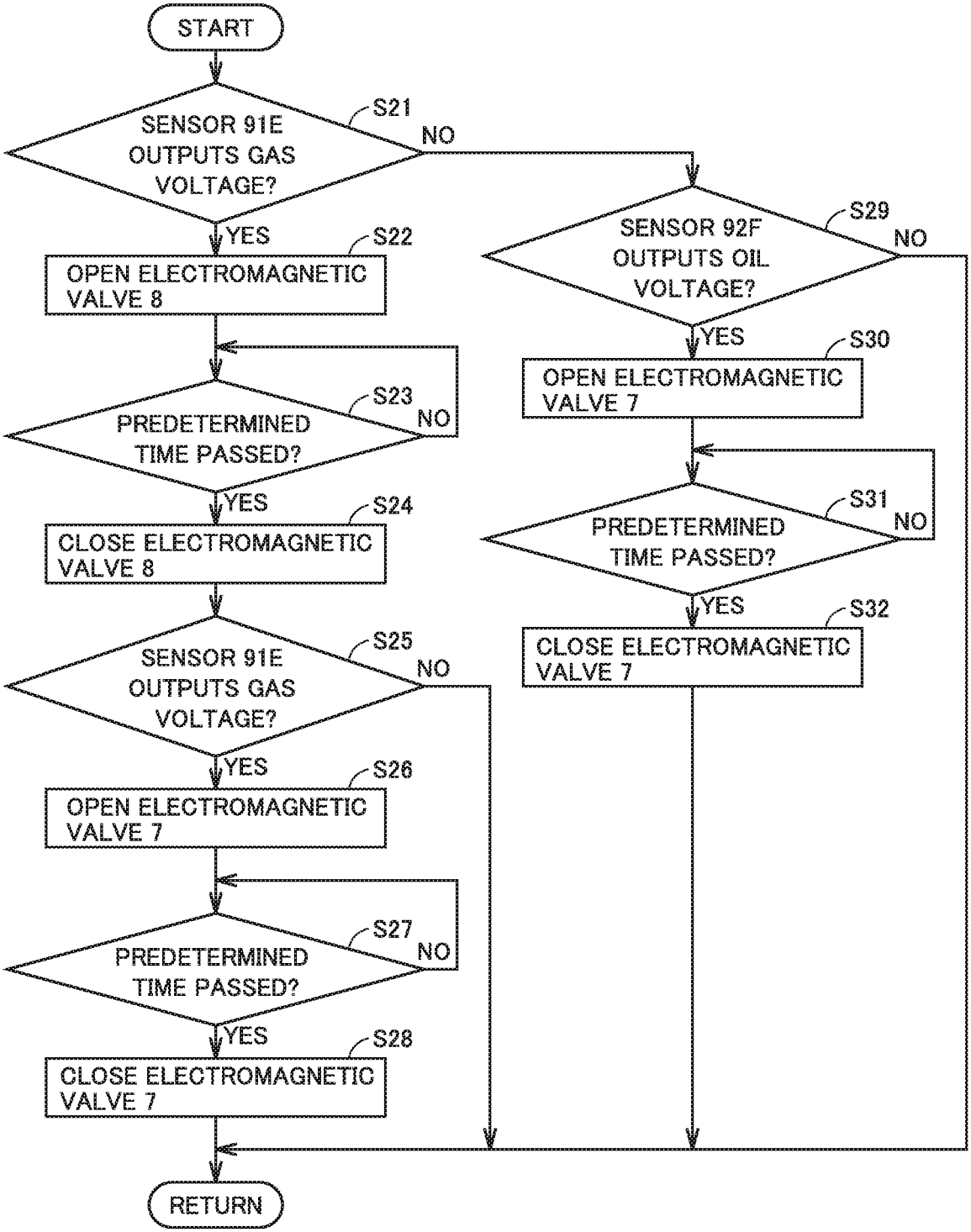
FIG. 8 is a flowchart for illustrating oil returning control in the third embodiment.

FIG. 8 is a flowchart for illustrating oil returning control in the third embodiment. With reference to FIG. 7 and FIG. 8, when the output of self-heating sensor 91E in compressor 1 indicates gas voltage Vsg (YES in S21), compressor 1 is in the oil shortage state. Then, controller 32 opens electromagnetic valve 8 on oil returning path 22 (S22), thereby returning the oil from accumulator 6 to compressor 1. After passage of a predetermined time from the start of the oil returning (YES in S23), electromagnetic valve 8 is closed (S24). When the output of sensor 91E indicates gas voltage Vsg at this point of time (YES in S25), the oil shortage state of compressor 1 is still continued. In order to compensate for the insufficiency of the refrigeration oil, electromagnetic valve 7 is opened to start returning the oil from oil separator 2 to compressor 1 (S26). After passage of a predetermined time (YES in S27), electromagnetic valve 7 is closed (S28) to end the oil returning.

On the other hand, when the output of sensor 91E does not indicate gas voltage Vsg (NO in S21), compressor 1 is not in the oil shortage state. However, when the output of sensor 92F indicates oil voltage Vso (YES in S29), the oil level of oil separator 2 has been increased, so that in order to lower the oil level, controller 32 opens electromagnetic valve 7 to start returning the oil actively from oil separator 2 to compressor 1 (S30). After passage of a predetermined time (YES in S31), controller 32 closes electromagnetic valve 7 (S32) to end the oil returning.

In the refrigeration cycle apparatus shown in the third embodiment, the oil shortage state in compressor 1 is detected by self-heating sensor 91E attached to compressor 1, whereas self-heating sensor 92F is also attached to oil separator 2 to detect accumulation of the refrigeration oil in oil separator 2. The refrigeration oil accumulated in oil separator 2 is returned actively. By performing the control in this way, the oil shortage state of compressor 1 can be reduced and the reliability of the refrigeration cycle apparatus can be secured. Moreover, during the oil returning, the oil returning from accumulator 6 having a low-pressure and low-temperature environment is performed prior to the oil returning from oil separator 2 having a high-temperature and high-pressure environment, whereby performance can be prevented from being decreased due to heat loss.

Fourth Embodiment

In each of the configurations shown in FIG. 1 and FIG. 7, self-heating sensor 91E is disposed at the low shell portion of compressor 1, which corresponds to the necessary minimum height (critical oil level position) for protection of compressor 1; however, in a fourth embodiment, the following describes a case where a self-heating sensor is disposed between the low shell portion and the motor of compressor 1.

Figure 9:
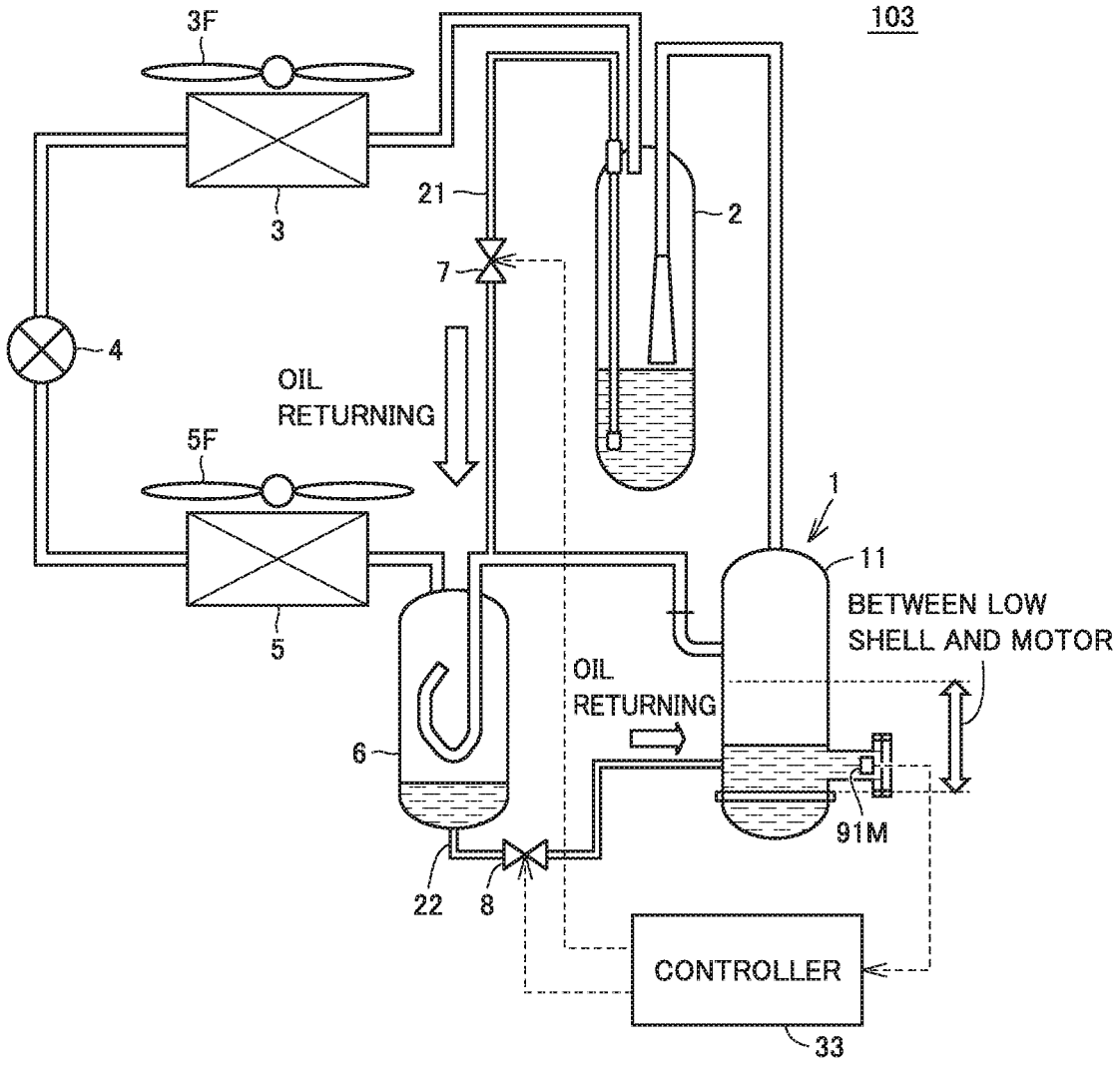
FIG. 9 is an entire configuration diagram of a refrigeration cycle apparatus according to a fourth embodiment.

FIG. 9 is an entire configuration diagram of a refrigeration cycle apparatus according to the fourth embodiment. A refrigeration cycle apparatus 103 shown in FIG. 9 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Between the low shell portion and the motor of compressor 1, one self-heating sensor 91M is attached. Controller 33 opens and closes electromagnetic valves 7, 8 to respectively return the oil from oil separator 2 and accumulator 6 to compressor 1.

Figure 10:
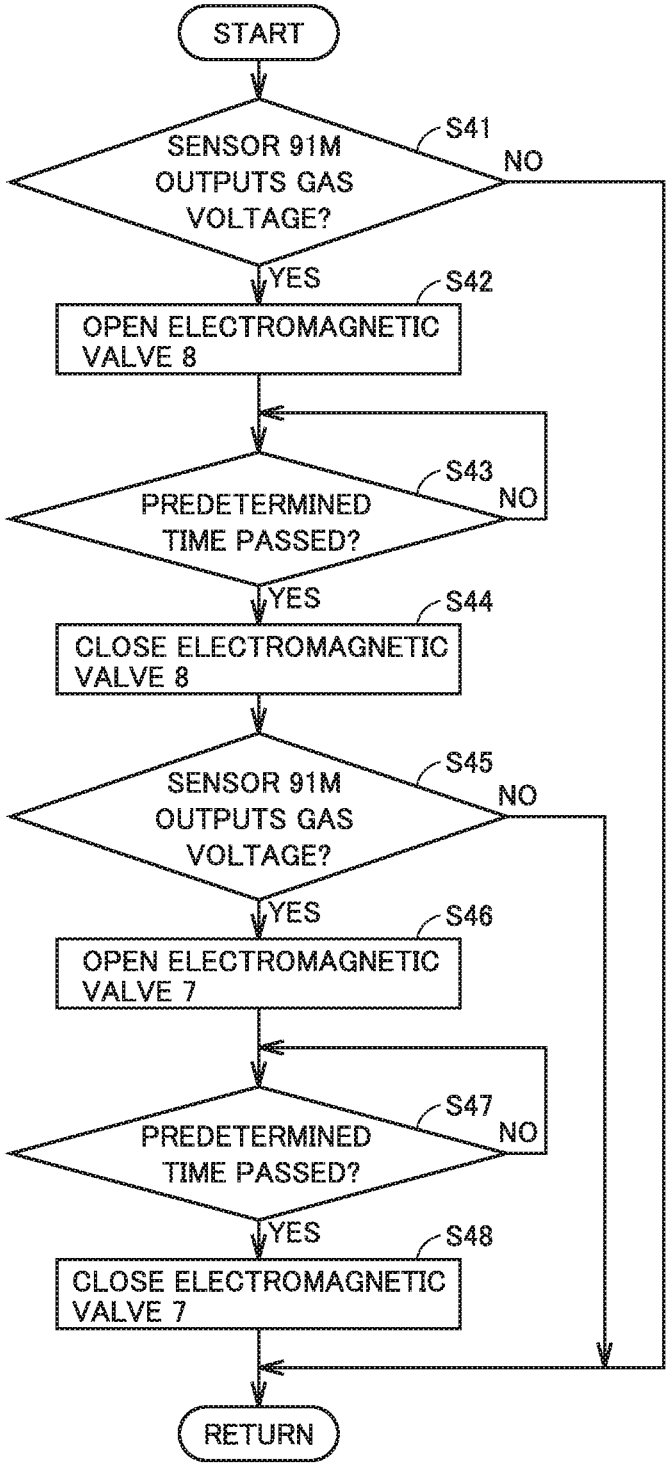
FIG. 10 is a flowchart for illustrating oil returning control in the fourth embodiment.

FIG. 10 is a flowchart for illustrating oil returning control in the fourth embodiment. With reference to FIG. 9 and FIG. 10, when the output of self-heating sensor 91M in compressor 1 indicates gas voltage Vsg (YES in S41), compressor 1 has become close to the oil shortage state. Then, controller 33 opens electromagnetic valve 8 on oil returning path 22, thereby returning the oil from accumulator 6 to compressor 1 (S42). After passage of a predetermined time (YES in S43), controller 33 closes electromagnetic valve 8 (S44). When the output of sensor 91M indicates gas voltage Vsg at this point of time (YES in S45), the state close to the oil shortage of compressor 1 is still continued. In order to compensate for the insufficiency of the refrigeration oil, controller 33 opens electromagnetic valve 7 to start returning the oil from oil separator 2 to compressor 1 (S46). After passage of the predetermined time (YES in S47), controller 33 closes electromagnetic valve 7 to end the oil returning (S48).

Fifth Embodiment

Figure 11:
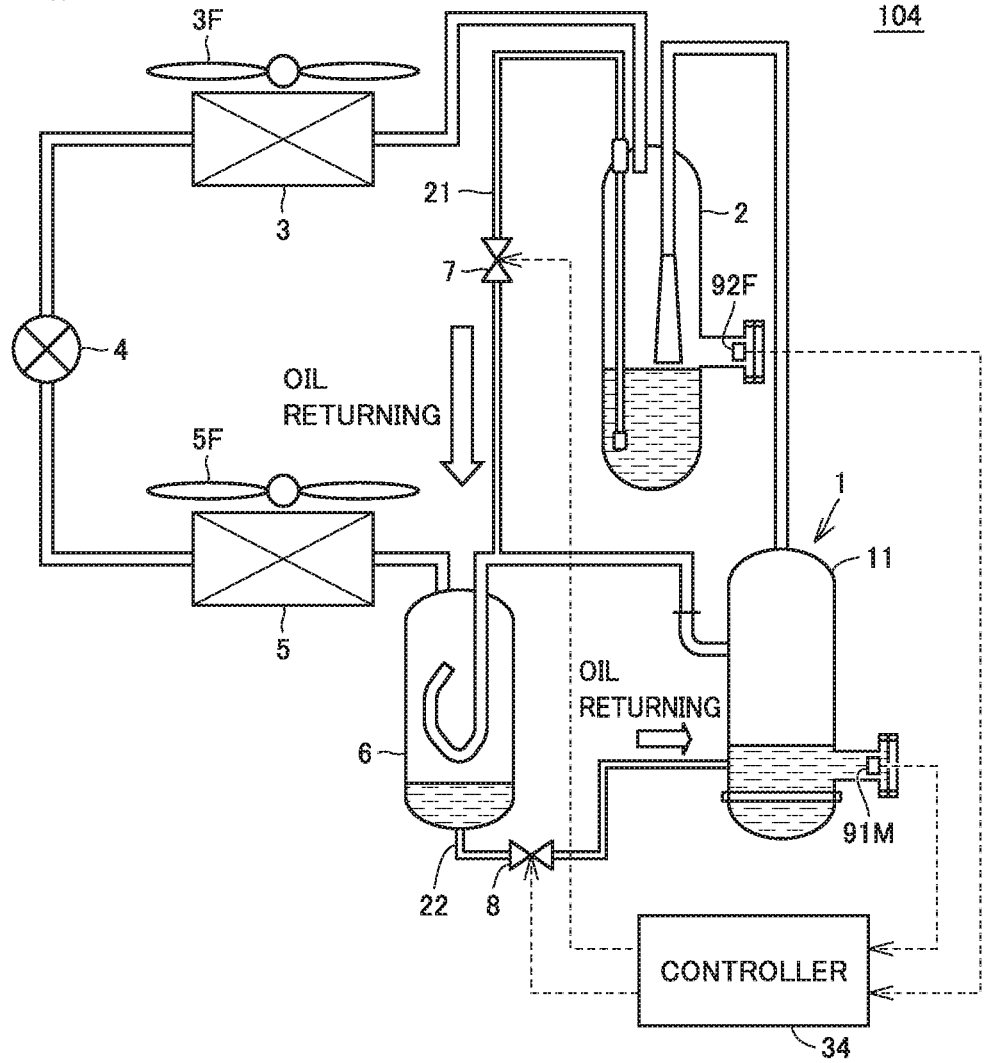
FIG. 11 is an entire configuration diagram of a refrigeration cycle apparatus according to a fifth embodiment.

FIG. 11 is an entire configuration diagram of a refrigeration cycle apparatus according to a fifth embodiment. In the configuration of refrigeration cycle apparatus 103 shown in FIG. 9, a refrigeration cycle apparatus 104 shown in FIG. 11 includes: self-heating sensor 91M disposed between the low shell portion and motor 10 of compressor 1; self-heating sensor 92F disposed in oil separator 2; and a controller 34 instead of controller 33. Refrigeration cycle apparatus 104 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Between the low shell portion and the motor of compressor 1, self-heating sensor 91M is attached. Self-heating sensor 92F is attached to oil separator 2. Controller 34 opens and closes electromagnetic valves 7, 8 to respectively return the oil from oil separator 2 and accumulator 6 to compressor 1.

Figure 12:
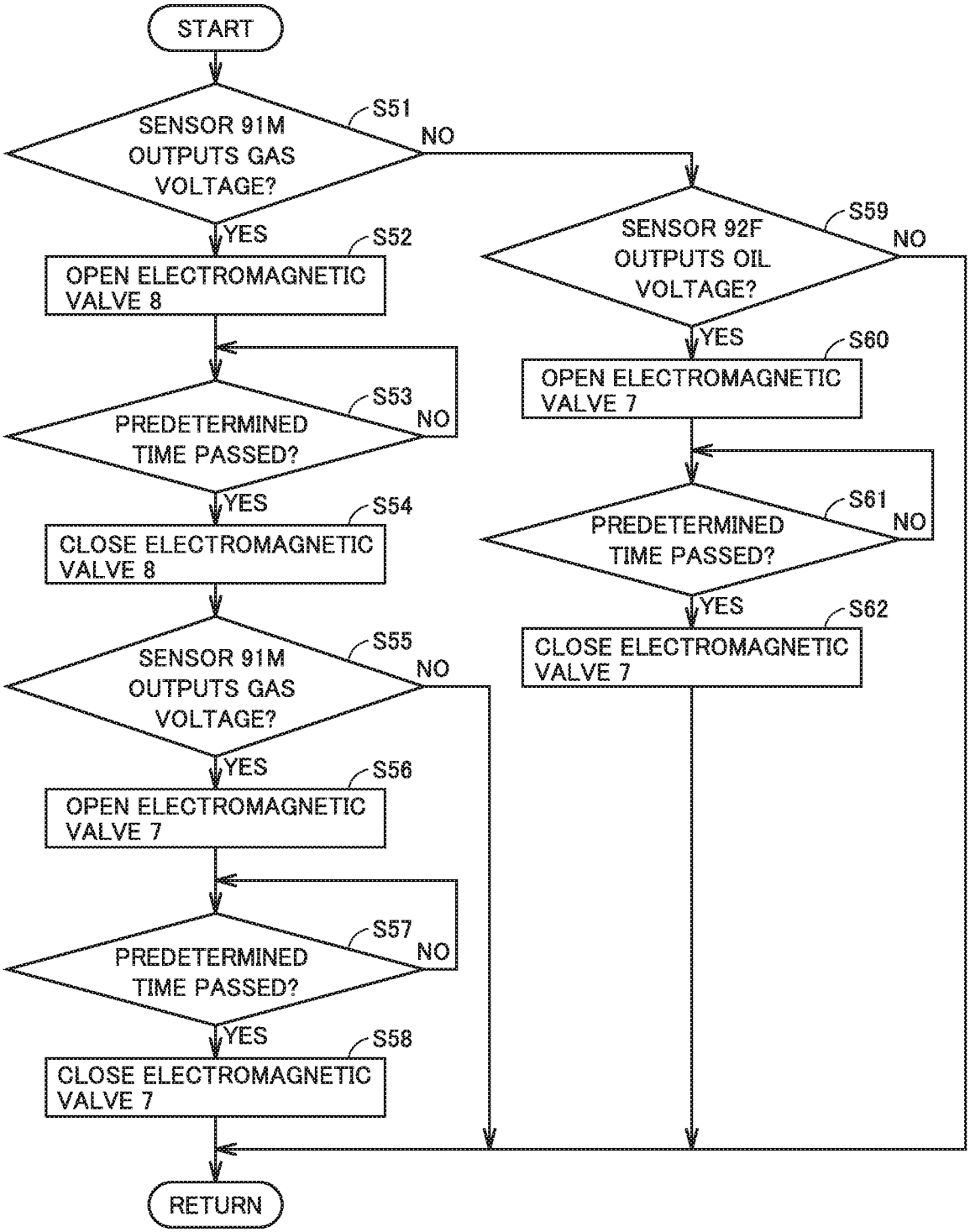
FIG. 12 is a flowchart for illustrating oil returning control in the fifth embodiment.

FIG. 12 is a flowchart for illustrating oil returning control in the fifth embodiment. With reference to FIG. 11 and FIG. 12, when the output of self-heating sensor 91M in compressor 1 indicates gas voltage Vsg (YES in S51), controller 34 opens electromagnetic valve 8 on oil returning path 22 to return the oil from accumulator 6 to compressor 1 (S52). After passage of a predetermined time (YES in S53), controller 34 closes electromagnetic valve 8 (S54). When the output of sensor 91M indicates gas voltage Vsg at this point of time (YES in S55), controller 34 opens electromagnetic valve 7 to start returning the oil from oil separator 2 to compressor 1 (S56). After passage of a predetermined time (YES in S57), controller 34 closes electromagnetic valve 7 to end the oil returning (S58).

On the other hand, when the output of sensor 91M does not indicate gas voltage Vsg (NO in S51), compressor 1 is not in the oil shortage state. However, when the output of sensor 92F indicates oil voltage Vso (YES in S59), the oil level of oil separator 2 has been increased, so that in order to lower the oil level, controller 34 opens electromagnetic valve 7 to start returning the oil actively from oil separator 2 to compressor 1 (S60). After passage of a predetermined time (YES in S61), controller 34 closes electromagnetic valve 7 (S62) to end the oil returning.

In the fifth embodiment above, self-heating sensor 91M is disposed between the critical oil level position (low shell portion) and motor 10 of compressor 1, and the oil returning is started always at a position higher than the critical oil level position. Therefore, compressor 1 is not brought into the oil shortage state, thus achieving an effect of securing reliability by the oil returning control employing electromagnetic valves 7, 8. The oil returning mechanism of the fifth embodiment is more excellent than that of the first embodiment in terms of the prevention of oil shortage.

Sixth Embodiment

In the configuration shown in FIG. 5, one self-heating sensor 92F is attached to oil separator 2; however, in a sixth embodiment, the following describes a case where a plurality of sensors are attached to oil separator 2.

Figure 13:
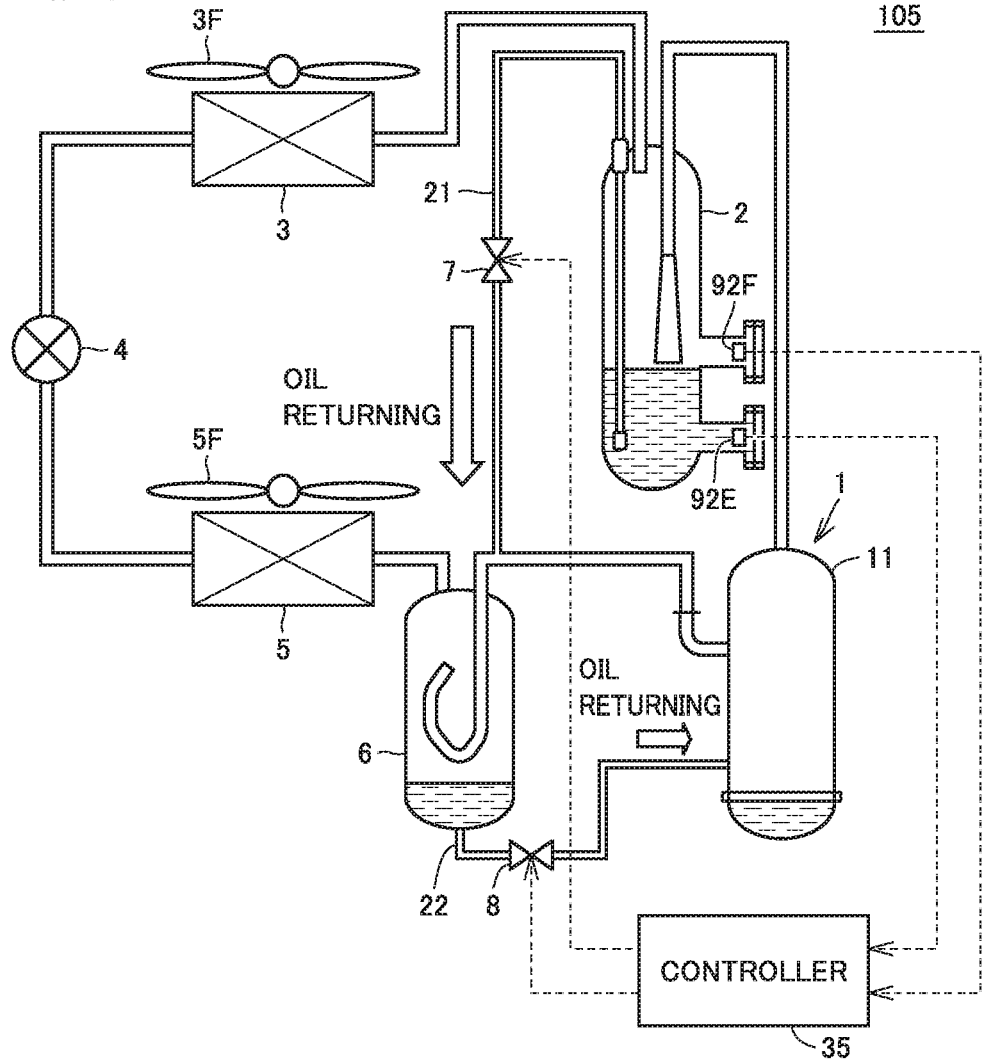
FIG. 13 is an entire configuration diagram of a refrigeration cycle apparatus according to a sixth embodiment.

FIG. 13 is an entire configuration diagram of a refrigeration cycle apparatus according to the sixth embodiment. In the configuration of refrigeration cycle apparatus 101 shown in FIG. 5, a refrigeration cycle apparatus 105 shown in FIG. 13 includes: self-heating sensor 92F disposed in oil separator 2; a self-heating sensor 92E disposed at a lower portion of oil separator 2: and a controller 35 instead of controller 31. Refrigeration cycle apparatus 105 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. The two sensors (self-heating sensor 92F and self-heating sensor 92E) are attached to oil separator 2. Controller 35 opens and closes electromagnetic valves 7, 8 to respectively return the oil from oil separator 2 and accumulator 6 to compressor 1.

Figure 14:
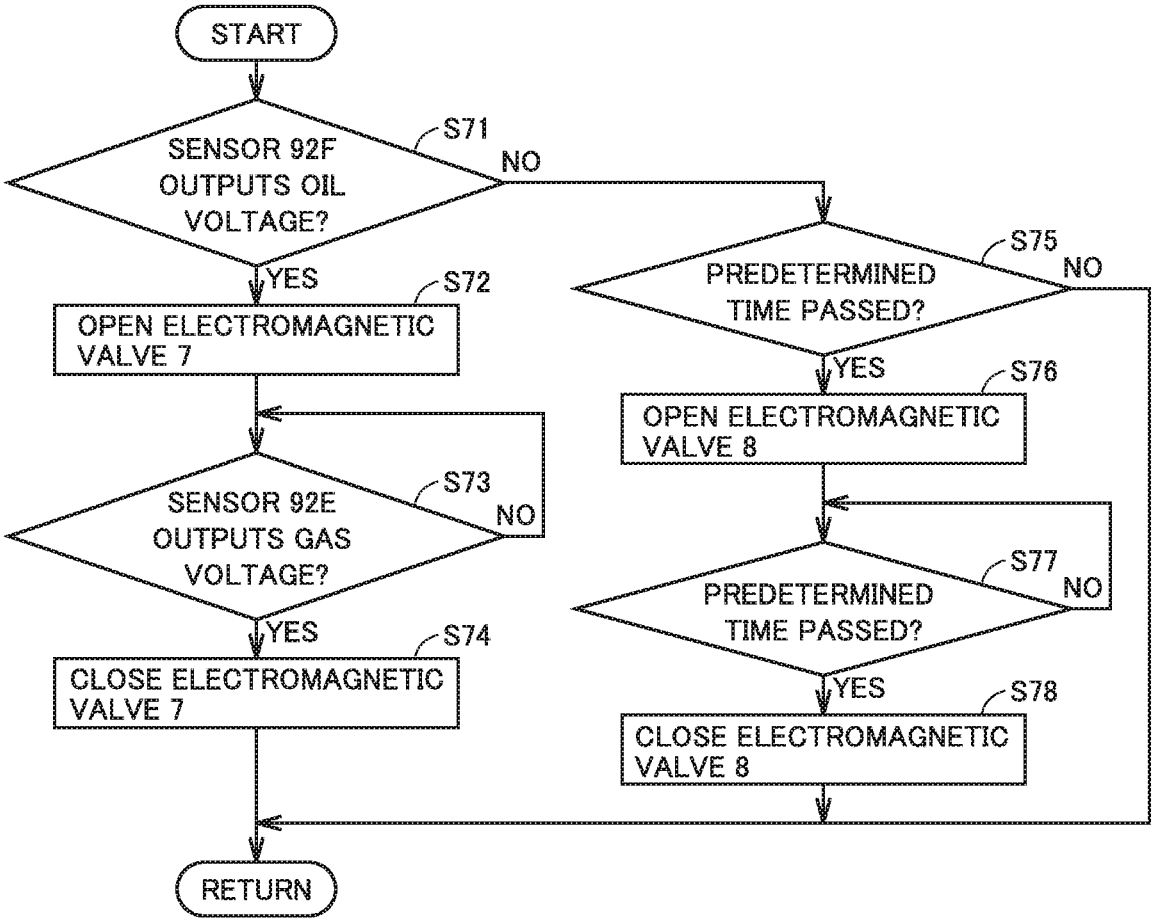
FIG. 14 is a flowchart for illustrating oil returning control in the sixth embodiment.

FIG. 14 is a flowchart for illustrating oil returning control in the sixth embodiment. With reference to FIG. 13 and FIG. 14, when the output of self-heating sensor 92F disposed at the upper portion in oil separator 2 indicates gas voltage Vsg (YES in S71), controller 35 opens electromagnetic valve 7 on oil returning path 21 to start returning the oil from oil separator 2 (S72). When the output of self-heating sensor 92E at the lower portion of oil separator 2 indicates gas voltage Vsg (YES in S73), it is found that a predetermined amount of the oil has been returned from oil separator 2 to compressor 1. Then, controller 35 closes electromagnetic valve 7 to end the oil returning (S74). Moreover, even when the output of sensor 92F does not indicate oil voltage Vso (NO in S71), after passage of a predetermined time (YES in S75), controller 35 opens electromagnetic valve 8 to start returning the oil actively (S76). Accordingly, the amount of the oil accumulated in accumulator 6 can be prevented from being increased too much. After passage of a predetermined time (YES in S77), controller 35 closes electromagnetic valve 7 to end the oil returning (S78).

Seventh Embodiment

Next, the following describes an embodiment in which self-heating sensors are disposed not only in oil separator 2 but also at the low shell portion of compressor 1 in the configuration of FIG. 13.

Figure 15:
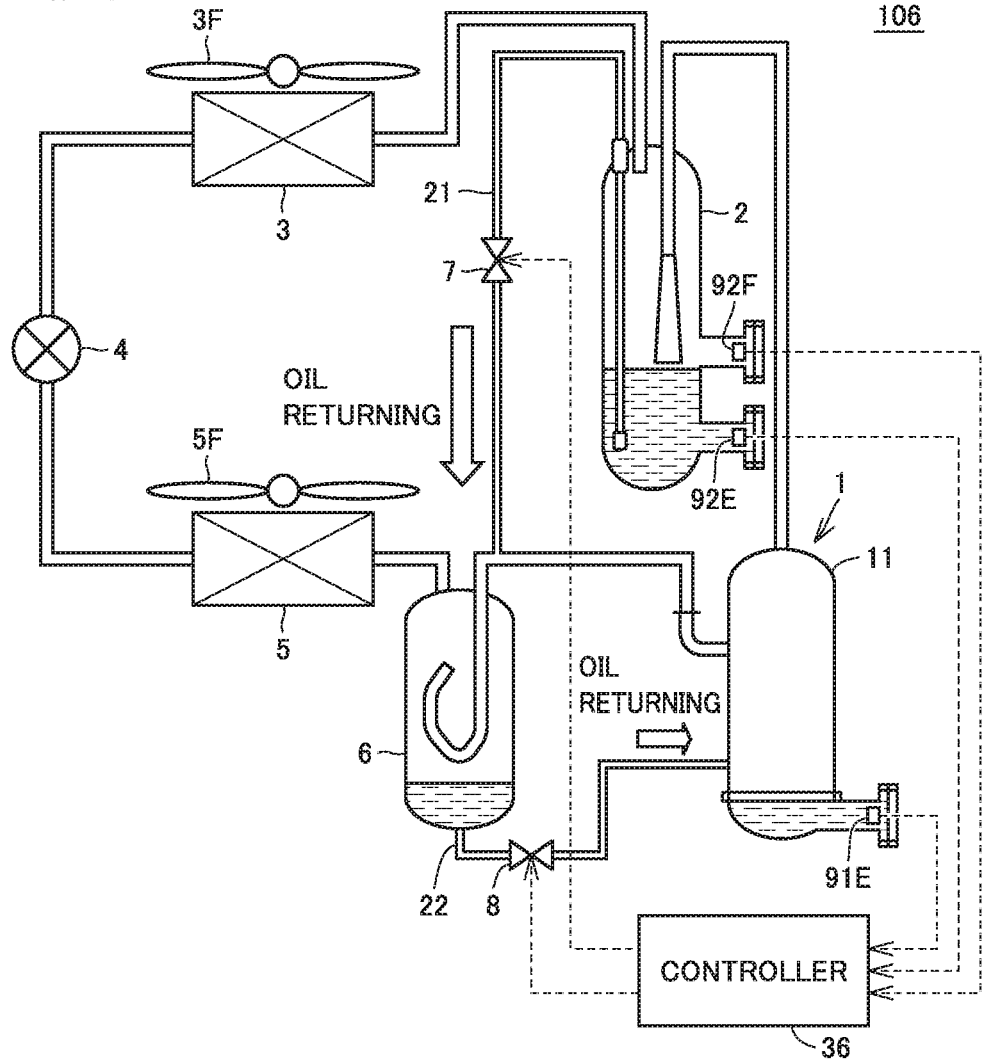
FIG. 15 is an entire configuration diagram of a refrigeration cycle apparatus according to a seventh embodiment.

FIG. 15 is an entire configuration diagram of a refrigeration cycle apparatus according to a seventh embodiment. In the configuration of refrigeration cycle apparatus 105 shown in FIG. 13, a refrigeration cycle apparatus 106 shown in FIG. 15 includes: self-heating sensors 92F, 92E disposed in oil separator 2; self-heating sensor 91E disposed at the low shell portion of compressor 1; and a controller 36 instead of controller 35. Refrigeration cycle apparatus 106 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Self-heating sensor 91E is attached to the low shell portion of compressor 1. Self-heating sensors 92F, 92E are attached to oil separator 2. Controller 35 opens and closes electromagnetic valves 7, 8 to respectively return the oil from oil separator 2 and accumulator 6 to compressor 1.

Figure 16:
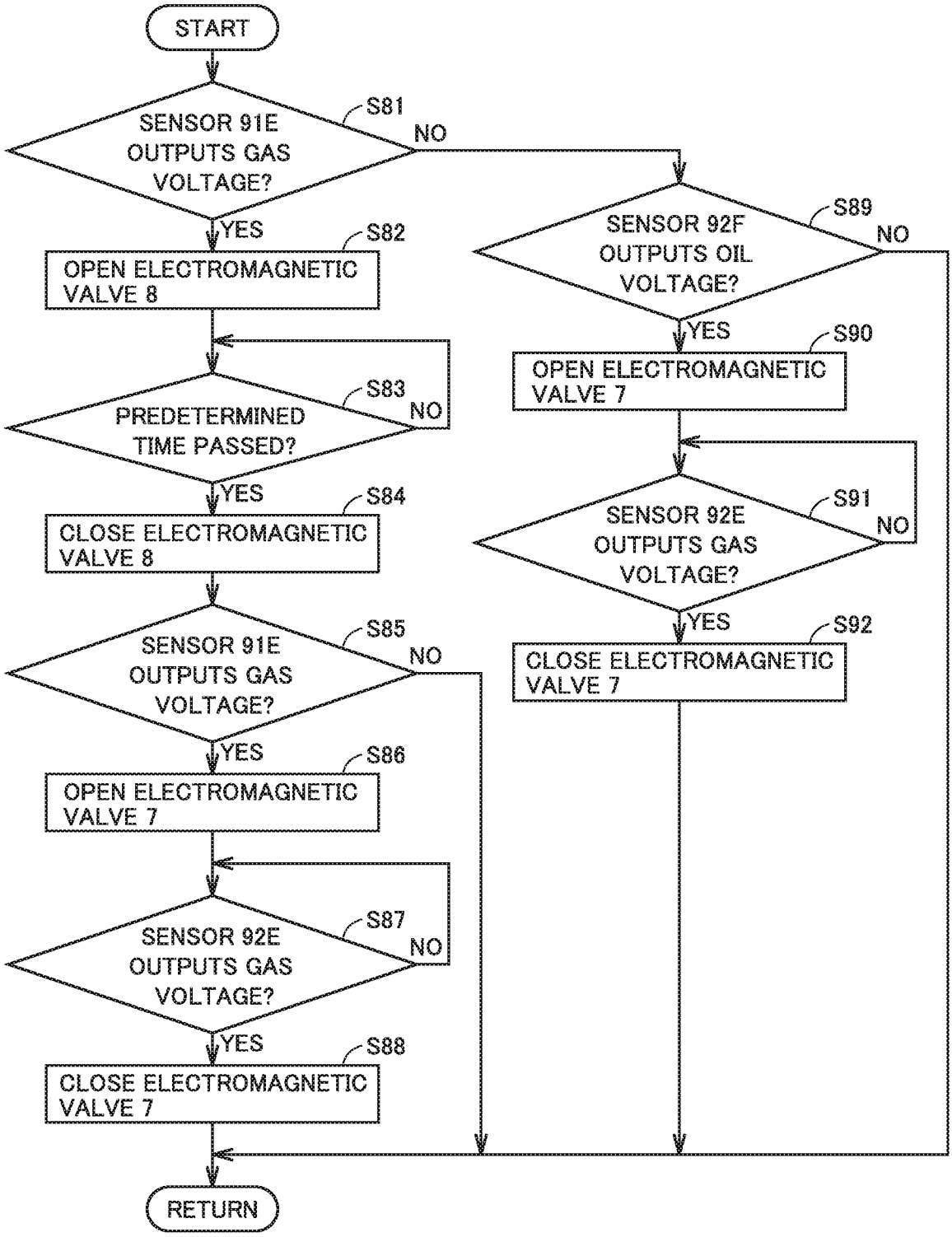
FIG. 16 is a flowchart for illustrating oil returning control in the seventh embodiment.

FIG. 16 is a flowchart for illustrating oil returning control in the seventh embodiment. With reference to FIG. 15 and FIG. 16, when the output of self-heating sensor 91E in compressor 1 indicates gas voltage Vsg (YES in S81), compressor 1 is in the oil shortage state. Then, by opening electromagnetic valve 8 on oil returning path 22, the oil starts to be returned from accumulator 6 (S82). After passage of a predetermined time (YES in S83), electromagnetic valve 8 is closed (S84). When the output of sensor 91E indicates gas voltage Vsg at this point of time (YES in step S85), the oil shortage state of compressor 1 is still continued. In order to compensate for the insufficiency of the refrigeration oil, electromagnetic valve 7 is opened to start returning the oil from oil separator 2 (S86). When the output of sensor 92E indicates gas voltage Vsg (YES in S87), it is found that the discharging of the refrigeration oil from oil separator 2 has been completed, so that controller 36 closes electromagnetic valve 7 to end the oil returning (S88).

On the other hand, when the output of sensor 91E does not indicate gas voltage Vsg (NO in S81), compressor 1 is not in the oil shortage state. However, when the output of sensor 92F indicates oil voltage Vso (YES in S89), the oil level of oil separator 2 has been increased, so that in order to lower the oil level, controller 36 opens electromagnetic valve 7 to start returning the oil actively from oil separator 2 to compressor 1 (S90). After the output of sensor 92E indicates gas voltage Vsg (YES in S91), controller 36 closes electromagnetic valve 7 to end the oil returning (S92).

In refrigeration cycle apparatus 106 shown in the seventh embodiment, the oil shortage state in compressor 1 is detected by self-heating sensor 91E attached in compressor 1, whereas self-heating sensors 92F, 92E are attached also in oil separator 2 so as to actively return the refrigeration oil accumulated in oil separator 2, whereby the oil shortage state of compressor 1 can be reduced and the reliability can be secured. By determining to end the oil returning using lower sensor 92E of oil separator 2, only the refrigeration oil can be accurately returned, thereby preventing the refrigerator performance from being decreased due to a reduced refrigerant flow rate. Refrigeration cycle apparatus 106 is more excellent than the configuration shown in FIG. 1 in that the performance can be prevented from being decreased by returning also the refrigerant during the oil returning.

Eighth Embodiment

Each of the configurations shown in FIG. 1, FIG. 7, FIG. 9, FIG. 1, and FIG. 15 is directed to an embodiment in which at least one self-heating sensor 91E or 91M is provided in compressor 1; however, in an eighth embodiment, the following describes an oil returning mechanism when a plurality of sensors are attached to compressor 1.

Figure 17:
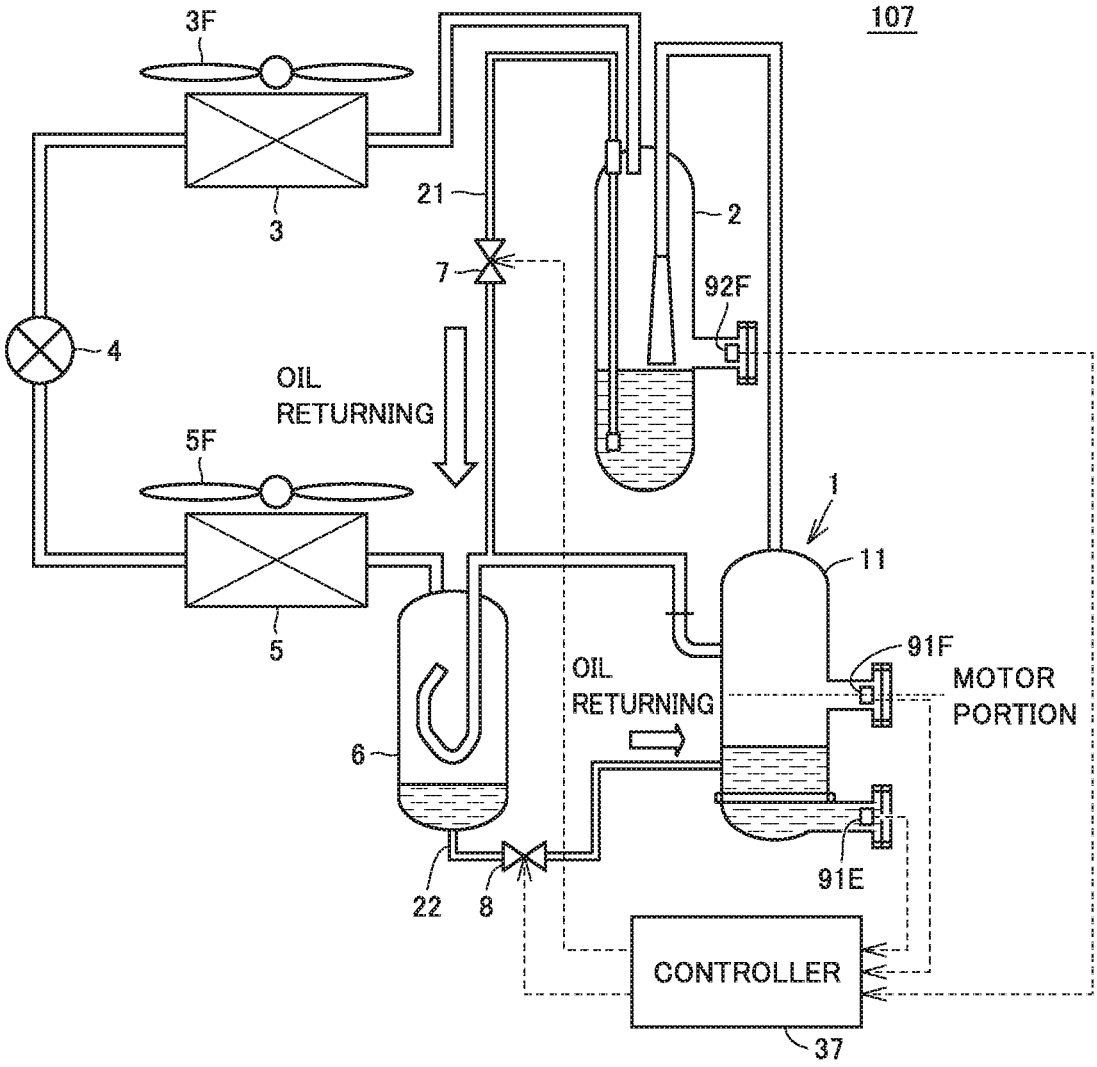
FIG. 17 is an entire configuration diagram of a refrigeration cycle apparatus according to an eighth embodiment.

FIG. 17 is an entire configuration diagram of a refrigeration cycle apparatus according to the eighth embodiment. In the configuration of refrigeration cycle apparatus 102 shown in FIG. 7, a refrigeration cycle apparatus 107 shown in FIG. 17 includes: self-heating sensor 92F disposed in oil separator 2; self-heating sensor 91E disposed at the low shell portion of compressor 1; self-heating sensor 91F disposed at the motor position of compressor 1; and a controller 37 instead of controller 32. Refrigeration cycle apparatus 107 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Sensor 91E is attached to the low shell portion of compressor 1, which corresponds to the critical oil level position. Moreover, sensor 91F is attached to the motor position of compressor 1. Moreover, self-heating sensor 92F is attached to oil separator 2.

Figure 18:
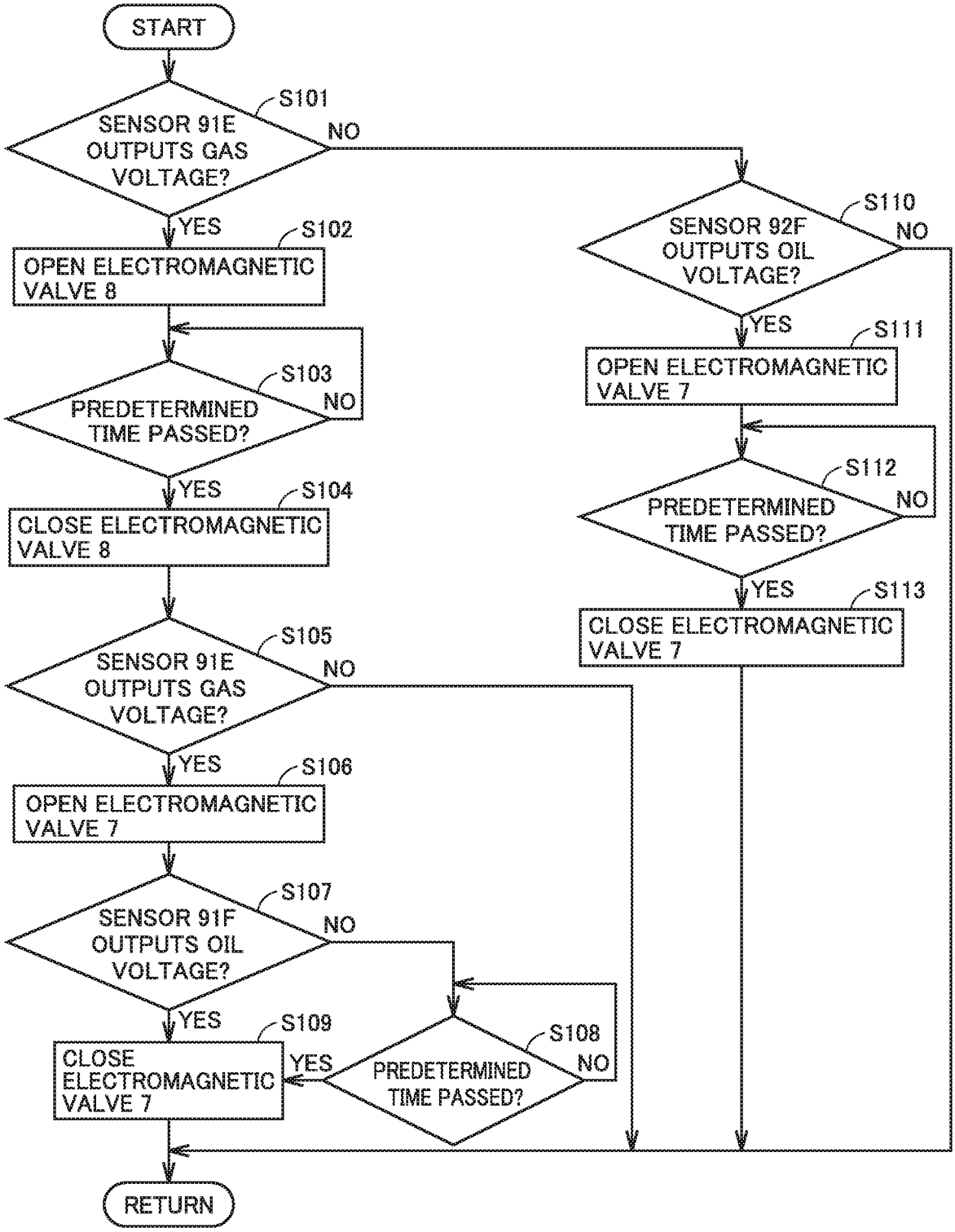
FIG. 18 is a flowchart for illustrating oil returning control in the eighth embodiment.

FIG. 18 is a flowchart for illustrating oil returning control in the eighth embodiment. With reference to FIG. 17 and FIG. 18, when the output of self-heating sensor 91E in compressor 1 indicates gas voltage Vsg (YES in S101), compressor 1 is in the oil shortage state. Then, controller 37 opens electromagnetic valve 8 on oil returning path 22, thereby returning the oil from accumulator 6 to compressor 1 (S102). After passage of a predetermined time (YES in S103), the refrigeration oil accumulated in accumulator 6 is released from accumulator 6. Hence, controller 37 closes electromagnetic valve 8 (S104). When the output of sensor 91E indicates gas voltage Vsg at this point of time (YES in step S105), the oil shortage state of compressor 1 is still continued. In order to compensate for the insufficiency of the refrigeration oil, controller 37 opens electromagnetic valve 7 to start returning the oil from oil separator 2 to compressor 1 (S106). When the output of sensor 91F indicates oil voltage Vso (YES in S107) or after passage of a predetermined time (YES in S108), controller 37 closes electromagnetic valve 7 to end the oil returning (S109).

On the other hand, when the output of sensor 91E does not indicate gas voltage Vsg (NO in S101), compressor 1 is not in the oil shortage state. However, when the output of sensor 92F indicates oil voltage Vso (YES in S110), the oil level of oil separator 2 has been increased. Thus, in order to lower the oil level, controller 37 opens electromagnetic valve 7 to start returning the oil actively (S11). After passage of the predetermined time (YES in S112), controller 37 closes electromagnetic valve 7 to end the oil returning (S113).

In the refrigeration cycle apparatus according to the eighth embodiment, the oil shortage state in compressor 1 is detected by self-heating sensor 91E attached in compressor 1, whereas self-heating sensor 92F is also attached in oil separator 2 to detect accumulation of the refrigeration oil in oil separator 2. The refrigeration oil accumulated in oil separator 2 is returned actively. By performing the control in this way, the oil shortage state of compressor 1 can be reduced and the reliability of the refrigeration cycle apparatus can be secured. Moreover, by determining the oil returning upper limit using self-heating sensor 91F attached to the motor position of compressor 1, the motor can be prevented from being soaked in the refrigeration oil, thereby avoiding the performance of the compressor from being decreased. The refrigeration cycle apparatus of the eighth embodiment is more excellent than the refrigeration cycle apparatus of the first embodiment in that the amount of the oil in compressor 1 can be prevented from being excessive and the volume efficiency of the compressor can be prevented from being decreased.

Ninth Embodiment

The configuration shown in FIG. 17 is directed to an embodiment in which self-heating sensors 91E. 91F are provided at the low shell portion and the motor position in compressor 1 and sensor 92F is provided in oil separator 2. On the other hand, in a ninth embodiment, the following describes an embodiment in which one self-heating sensor 91M is provided at a position between the low shell portion and the motor in compressor 1, one self-heating sensor 91F is provided at the motor position in compressor 1, and one sensor 92F is disposed in oil separator 2.

Figure 19:
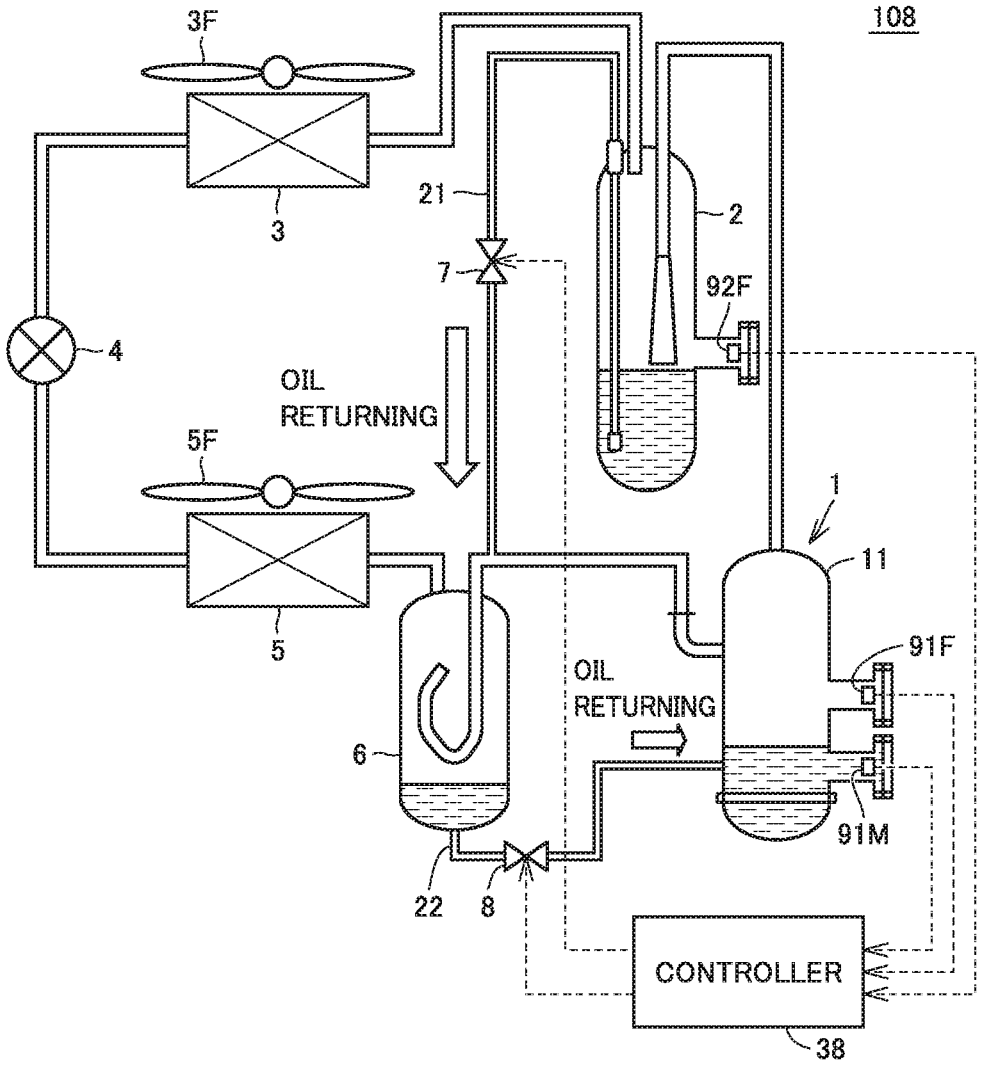
FIG. 19 is an entire configuration diagram of a refrigeration cycle apparatus according to a ninth embodiment.

FIG. 19 is an entire configuration diagram of a refrigeration cycle apparatus according to the ninth embodiment. In the configuration of refrigeration cycle apparatus 107 shown in FIG. 17, a refrigeration cycle apparatus 108 shown in FIG. 19 includes: a self-heating sensor 91M instead of self-heating sensor 91E; and a controller 38 instead of controller 37.

Refrigeration cycle apparatus 108 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22.

Electromagnetic valves 7, 8 are disposed on oil returning paths 21, 22 respectively. Self-heating sensor 91M is attached to the position between the motor and the low shell portion corresponding to the critical oil level position in compressor 1, and self-heating sensor 91F is attached to the motor position of compressor 1. Moreover, one self-heating sensor 92F is attached to oil separator 2.

Figure 20:
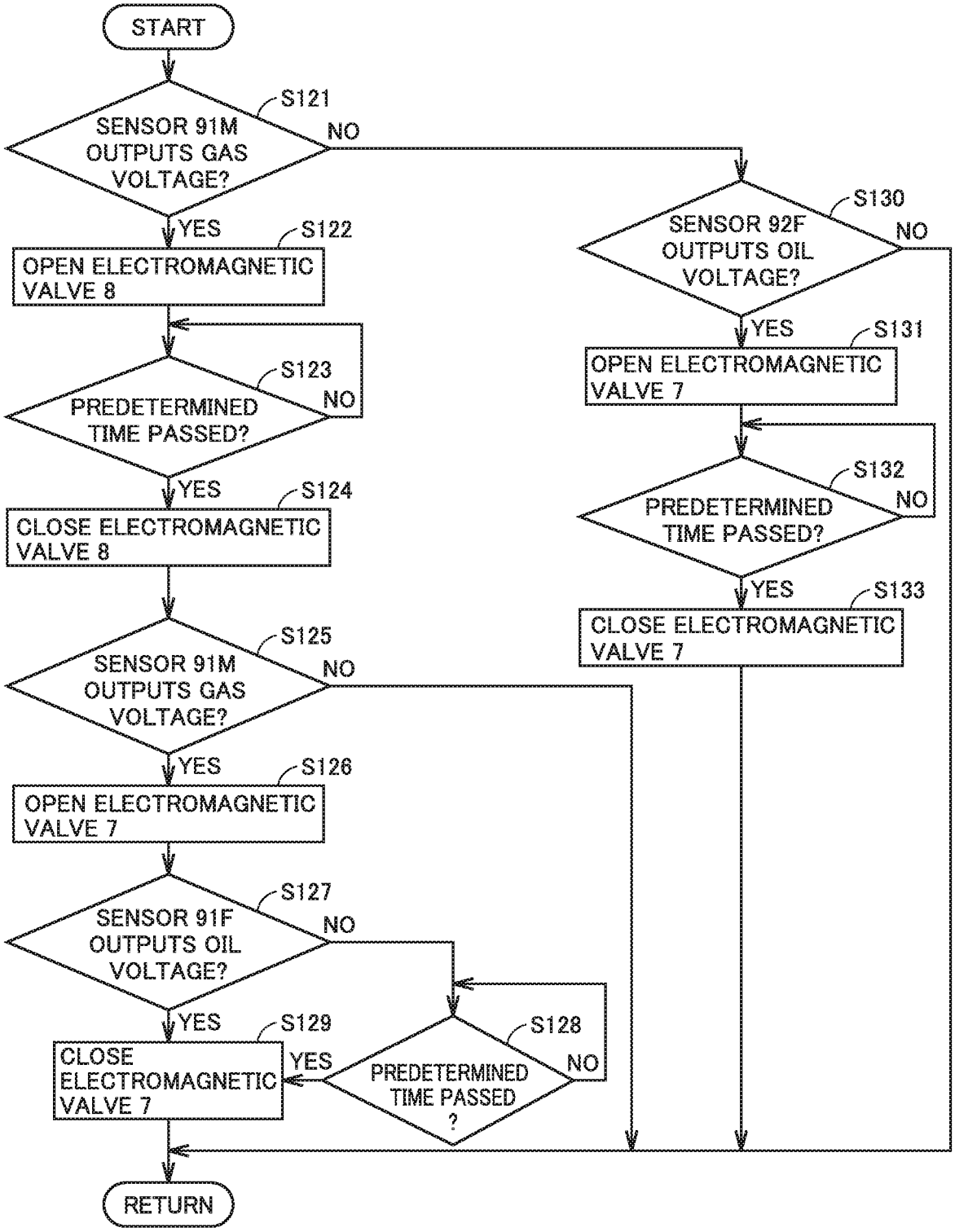
FIG. 20 is a flowchart for illustrating oil returning control in the ninth embodiment.

FIG. 20 is a flowchart for illustrating oil returning control in the ninth embodiment. With reference to FIG. 19 and FIG. 20, when the output of self-heating sensor 91M in compressor 1 indicates gas voltage Vsg (YES in S121), compressor 1 has become close to the oil shortage state. Then, controller 38 opens electromagnetic valve 8 on oil returning path 22, thereby returning the oil from accumulator 6 to compressor 1 (S122). After passage of a predetermined time (YES in S123), the refrigeration oil accumulated in accumulator 6 is released from accumulator 6. Hence, controller 38 closes electromagnetic valve 8 (S124). When the output of sensor 91M indicates gas voltage Vsg at this point of time (YES in S125), the state close to the oil shortage of compressor 1 is still continued. In order to compensate for the insufficiency of the refrigeration oil, controller 38 opens electromagnetic valve 7 to start returning the oil from oil separator 2 to compressor 1 (S126). When the output of sensor 91F indicates oil voltage Vso (YES in S107) or after passage of a predetermined time (YES in S108), controller 38 closes electromagnetic valve 7 to end the oil returning (S129).

On the other hand, when the output of sensor 91M does not indicate gas voltage Vsg (NO in S121), compressor 1 is not in the oil shortage state. However, when the output of sensor 92F indicates oil voltage Vso (YES in S130), the oil level of oil separator 2 has been increased. Thus, in order to lower the oil level, controller 38 opens electromagnetic valve 7 to start returning the oil actively (S131). After passage of a predetermined time (YES in S132), controller 38 closes electromagnetic valve 7 to end the oil returning (S133).

In the refrigeration cycle apparatus according to the ninth embodiment, decrease in the oil-level in compressor 1 is detected at an early stage using self-heating sensor 91M attached slightly above the lower portion in compressor 1 so as to return the oil from accumulator 6 and oil separator 2. Meanwhile, self-heating sensor 92F is attached also to oil separator 2 to actively return the refrigeration oil accumulated in oil separator 2, thereby maintaining the oil level in compressor 1 to be always equal to or higher than the critical oil level. These make it possible to secure the reliability of the refrigeration cycle apparatus. Moreover, by determining the oil returning upper limit using self-heating sensor 91F attached to the motor position of compressor 1, the motor can be prevented from being soaked in the liquid, thereby avoiding the performance of compressor 1 from being decreased.

The refrigeration cycle apparatus of the ninth embodiment is more excellent than the refrigeration cycle apparatus of the first embodiment in that by preventing an excessive amount of oil in compressor 1, the volume efficiency of the compressor can be avoided from being decreased and oil shortage can be prevented.

Tenth Embodiment

Next, the following describes an embodiment in which one self-heating sensor 91M is provided between the low shell portion and the motor of compressor 1 and two sensors 92F, 92E are provided at the upper and lower sides of oil separator 2.

Figure 21:
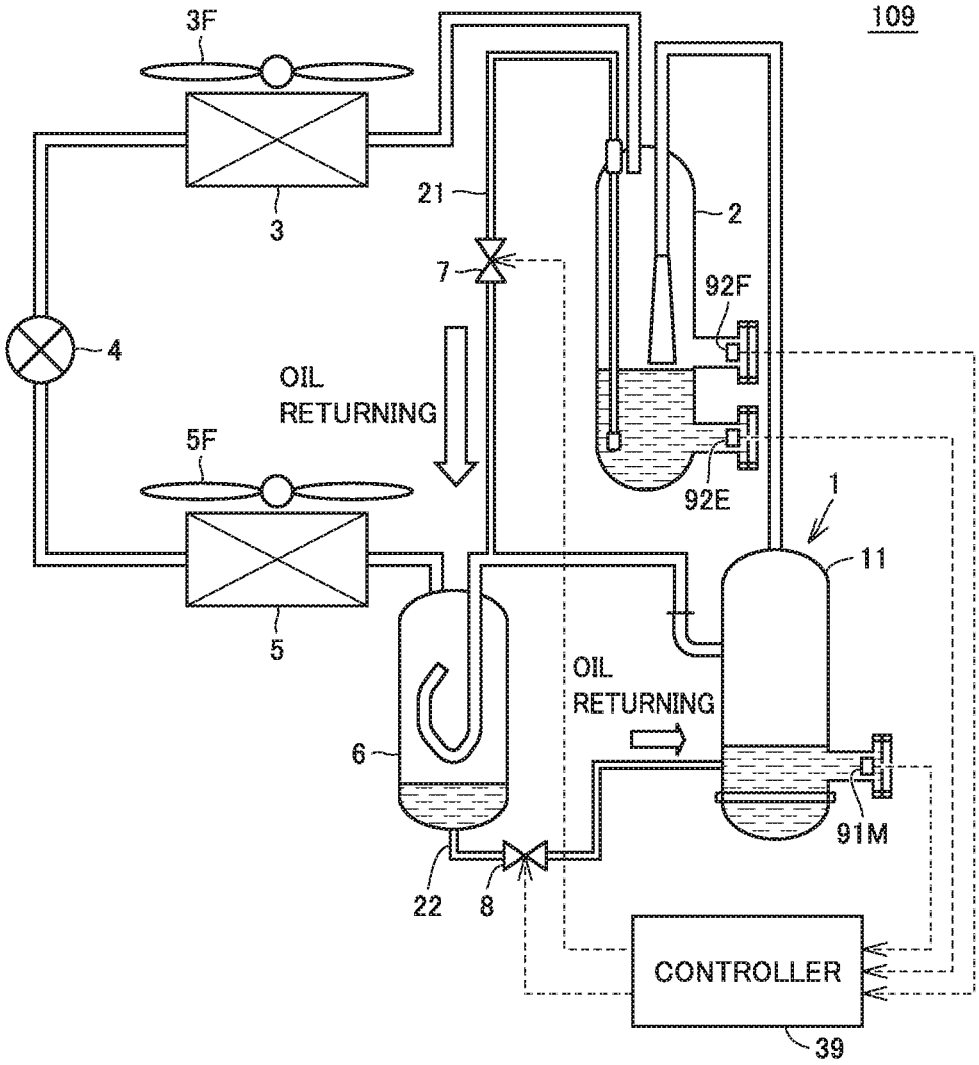
FIG. 21 is an entire configuration diagram of a refrigeration cycle apparatus according to a tenth embodiment.

FIG. 21 is an entire configuration diagram of a refrigeration cycle apparatus according to a tenth embodiment. A refrigeration cycle apparatus 109 shown in FIG. 21 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Self-heating sensor 91M is attached between the low shell portion and the motor portion of compressor 1, and two self-heating sensors 92F, 92E are attached at the upper and lower sides of oil separator 2.

Figure 22:
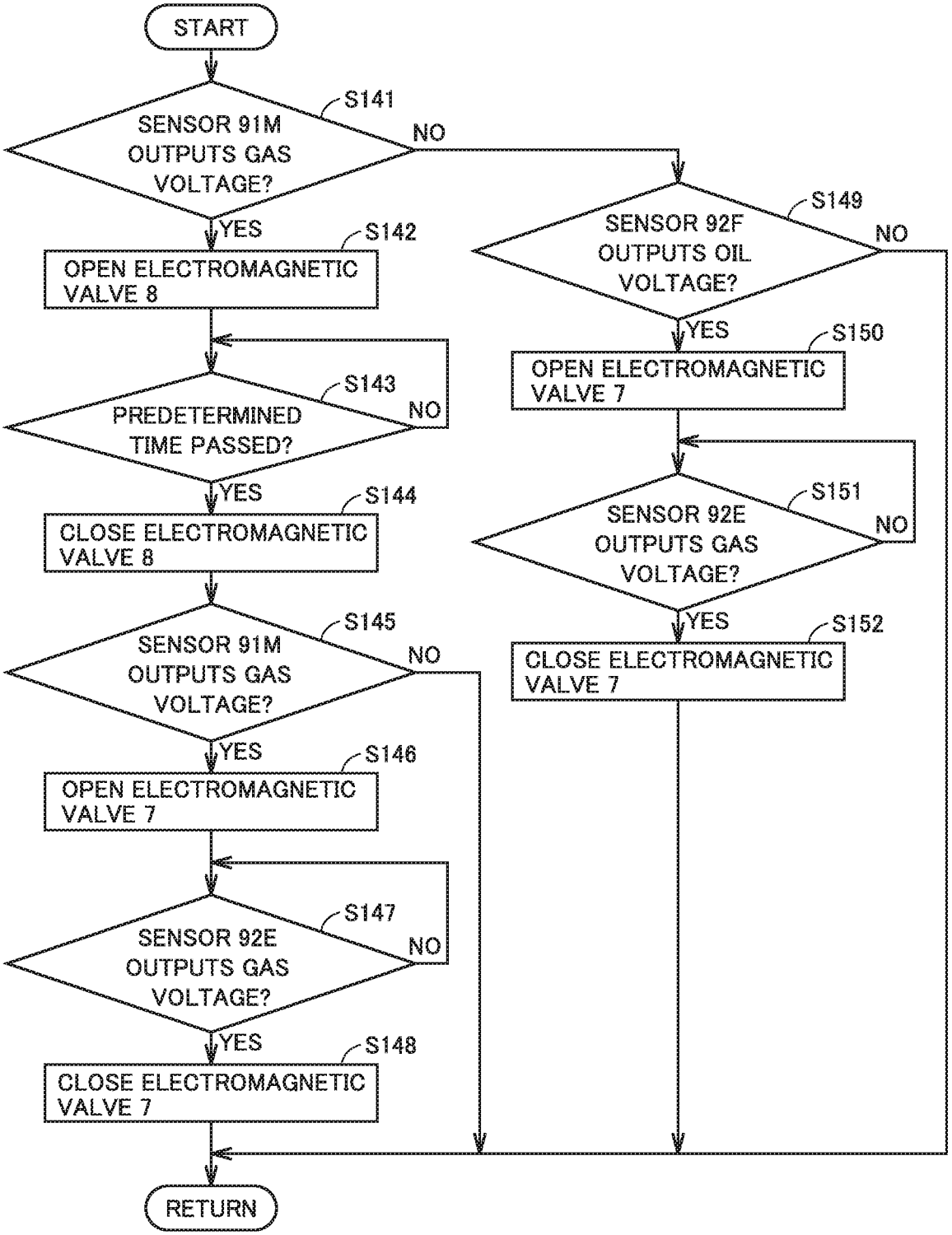
FIG. 22 is a flowchart for illustrating oil returning control in the tenth embodiment.

FIG. 22 is a flowchart for illustrating oil returning control in the tenth embodiment. With reference to FIG. 21 and FIG. 22, when the output of self-heating sensor 91M in compressor 1 indicates gas voltage Vsg (YES in S141), compressor 1 is in a state close to oil shortage. Then, controller 39 opens electromagnetic valve 8 on oil returning path 22, thereby returning the oil from accumulator 6 to compressor 1 (S142). After passage of a predetermined time (YES in S143), the refrigeration oil accumulated in accumulator 6 is released from accumulator 6. Then, controller 39 closes electromagnetic valve 8 (S144). When the output of sensor 91M indicates gas voltage Vsg at this point of time (YES in S145), compressor 1 is still continued to be in the state close to the oil shortage. In order to compensate for the insufficiency of the refrigeration oil, controller 39 opens electromagnetic valve 7 to start returning the oil from oil separator 2 to compressor 1 (S146). When sensor 92E outputs the gas voltage (YES in S147), it is found that the release of the refrigeration oil stored in oil separator 2 has been completed. Then, controller 39 closes electromagnetic valve 7 to end the oil returning (S148).

On the other hand, when the output of sensor 91M does not indicate gas voltage Vsg (NO in S141), compressor 1 is not in the oil shortage state. However, when the output of sensor 92F indicates oil voltage Vso (YES in S149), the oil level of oil separator 2 has been increased, so that in order to lower the oil level, controller 39 opens electromagnetic valve 7 to start returning the oil actively (S150). When sensor 92E outputs the gas voltage and the amount of oil in oil separator 2 is decreased (YES in S151), controller 39 closes electromagnetic valve 7 to end the oil returning (S152).

In the tenth embodiment, decrease in oil level in compressor 1 is detected by self-heating sensor 91M attached slightly above the lower portion in compressor 1 to return the oil from accumulator 6 and oil separator 2. Accordingly, the oil level in compressor 1 is always maintained to be above the critical oil level. Moreover, self-heating sensor 92F is attached also to oil separator 2 to detect that the refrigeration oil has been accumulated in oil separator 2. The refrigeration oil accumulated in oil separator 2 is returned actively. These make it possible to secure the reliability of the refrigeration cycle apparatus. Meanwhile, by determining to end the oil returning using sensor 92E at the lower portion of oil separator 2, it is possible to accurately return only the refrigeration oil, thereby preventing the refrigerator performance from being decreased due to a reduced refrigerant flow rate. The refrigeration cycle apparatus of the tenth embodiment is more excellent than the refrigeration cycle apparatus of the first embodiment in that: the refrigerator performance can be prevented from being decreased due to the refrigerant being returned together with the refrigeration oil during the oil returning; and the oil shortage can be prevented completely.

Eleventh Embodiment

In each of the above embodiments, it has been illustrated that at least one or at least two sensors were attached in compressor 1 and oil separator 2. In the eleventh embodiment, the following describes an embodiment in which two sensors are provided in each of compressor 1 and oil separator 2.

Figure 23:
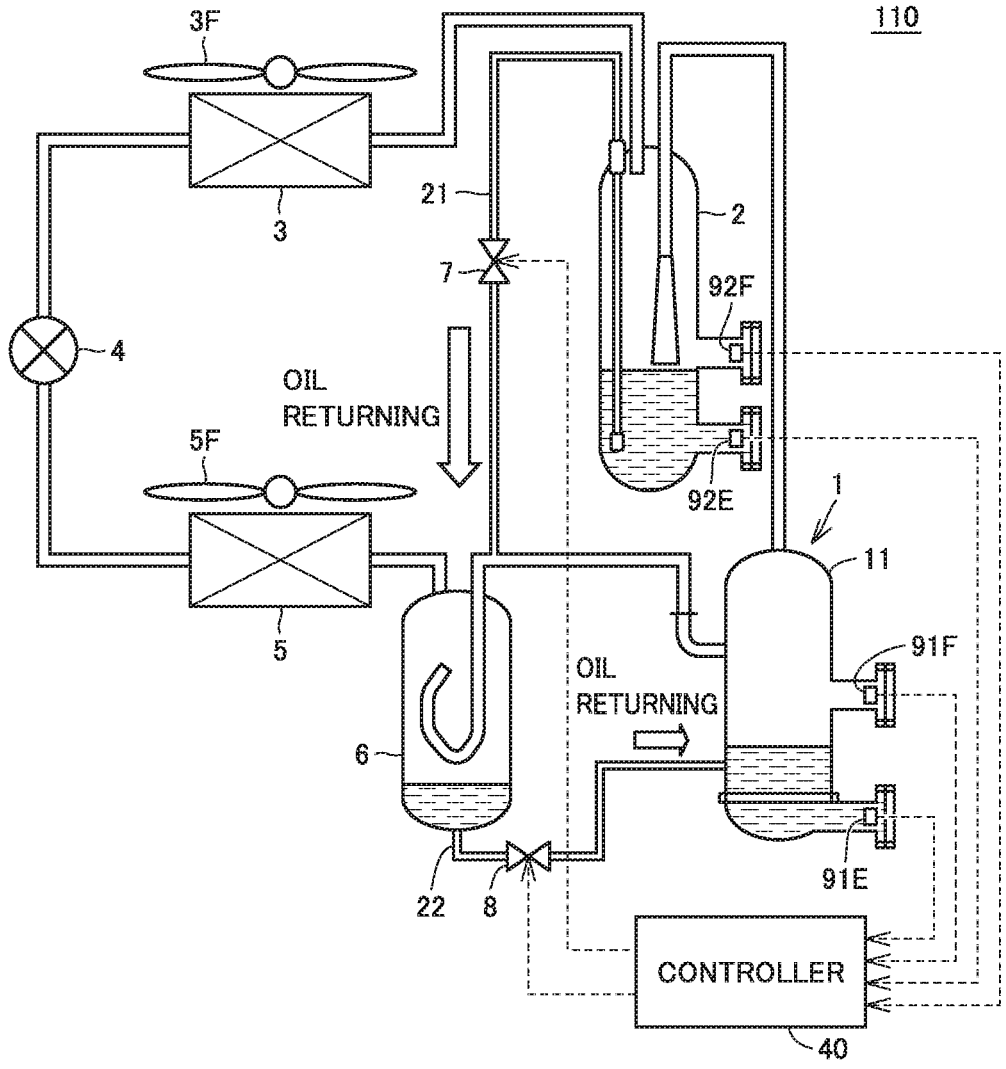
FIG. 23 is an entire configuration diagram of a refrigeration cycle apparatus according to an eleventh embodiment.

FIG. 23 is an entire configuration diagram of a refrigeration cycle apparatus according to the eleventh embodiment. Refrigeration cycle apparatus 110 shown in FIG. 23 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Self-heating sensor 91E is provided at the low shell portion of compressor 1, and self-heating sensor 91F is provided at the motor position of compressor 1. Moreover, two upper and lower self-heating sensors 92F, 92E are attached to oil separator 2.

Figure 24:
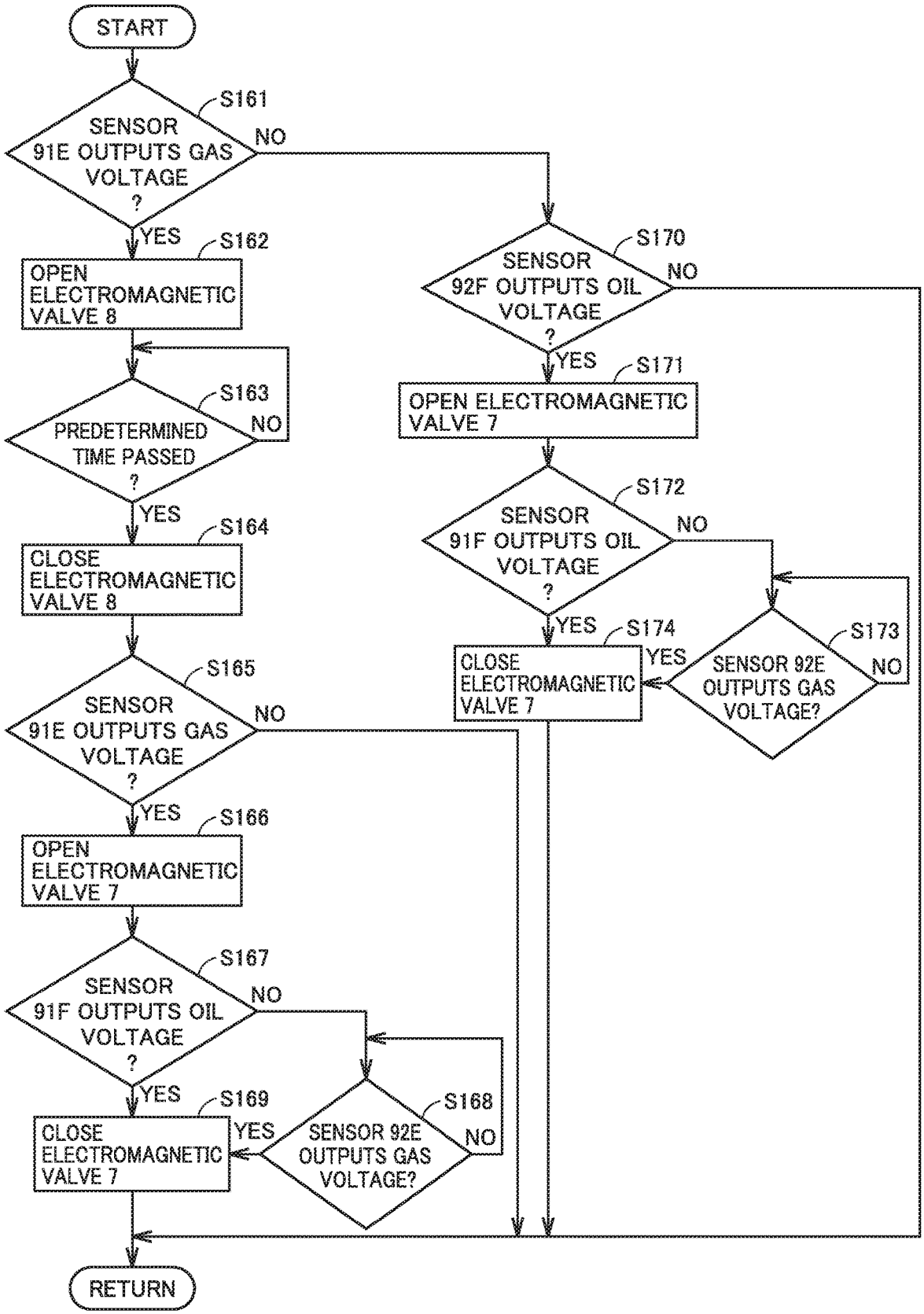
FIG. 24 is a flowchart for illustrating oil returning control in the eleventh embodiment.

FIG. 24 is a flowchart for illustrating oil returning control in the eleventh embodiment. With reference to FIG. 23 and FIG. 24, when the output of self-heating sensor 91E in compressor 1 indicates gas voltage Vsg (YES in S161), compressor 1 is in the oil shortage state. Then, controller 40 opens electromagnetic valve 8 on oil returning path 22, thereby returning the oil from accumulator 6 to compressor 1 (S162). After passage of a predetermined time (YES in S163), the refrigeration oil accumulated in accumulator 6 is released from accumulator 6. Then, controller 40 closes electromagnetic valve 8 (S164). When the output of sensor 91E indicates gas voltage Vsg at this point of time (YES in S165), the oil shortage state of compressor 1 is still continued. In order to compensate for the insufficiency of the refrigeration oil, controller 40 opens electromagnetic valve 7 to start returning the oil from oil separator 2 to compressor 1 (S166). When the output of sensor 91F indicates oil voltage Vso (YES in S167) or when the output of sensor 92E indicates gas voltage Vsg (YES in S168), controller 40 closes electromagnetic valve 7 to end the oil returning (S169).

On the other hand, when the output of sensor 91E does not indicate gas voltage Vsg (NO in S161), compressor 1 is not in the oil shortage state. However, when the output of sensor 92F indicates oil voltage Vso (YES in S170), the oil level of oil separator 2 has been increased, so that in order to lower the oil level, controller 40 opens electromagnetic valve 7 to start returning the oil actively (S171). When the output of sensor 91F indicates oil voltage Vso (YES in S172) or when sensor 92E outputs gas voltage and the amount of oil accumulated in oil separator 2 has been decreased (YES in S173), controller 40 closes electromagnetic valve 7 to end the oil returning (S174).

In the eleventh embodiment, the oil shortage state in compressor 1 is detected by self-heating sensor 91E attached to the lower portion in compressor 1 and the oil is returned from accumulator 6 and oil separator 2. On the other hand, self-heating sensor 92F is attached also to oil separator 2 to detect that the refrigeration oil has been accumulated in oil separator 2. The refrigeration oil accumulated in oil separator 2 is returned actively. By performing the control in this way, the oil shortage state of compressor 1 can be reduced and the reliability of the refrigeration cycle apparatus can be secured. Moreover, by determining the oil returning upper limit using self-heating sensor 91F attached to the motor position of compressor 1, the motor can be prevented from being soaked in the liquid, thereby avoiding the performance of compressor 1 from being decreased. Further, by determining to end the oil returning also using lower sensor 92E in oil separator 2, it is possible to accurately return only the refrigeration oil to the compressor, thereby preventing the refrigerator performance from being decreased due to a reduced refrigerant flow rate.

The eleventh embodiment is more excellent than the first embodiment in that the volume efficiency of compressor 1 can be avoided from being decreased due to an excessive amount of the oil in compressor 1 and the refrigerator performance can be prevented from being decreased due to the refrigerant being returned during the oil returning.

Twelfth Embodiment

In a twelfth embodiment, the following describes an embodiment in which one self-heating sensor is disposed at the position between the low shell portion and the motor of compressor 1, one self-heating sensor is disposed at the motor position, and two self-heating sensors are disposed at the upper and lower sides of oil separator 2.

Figure 25:
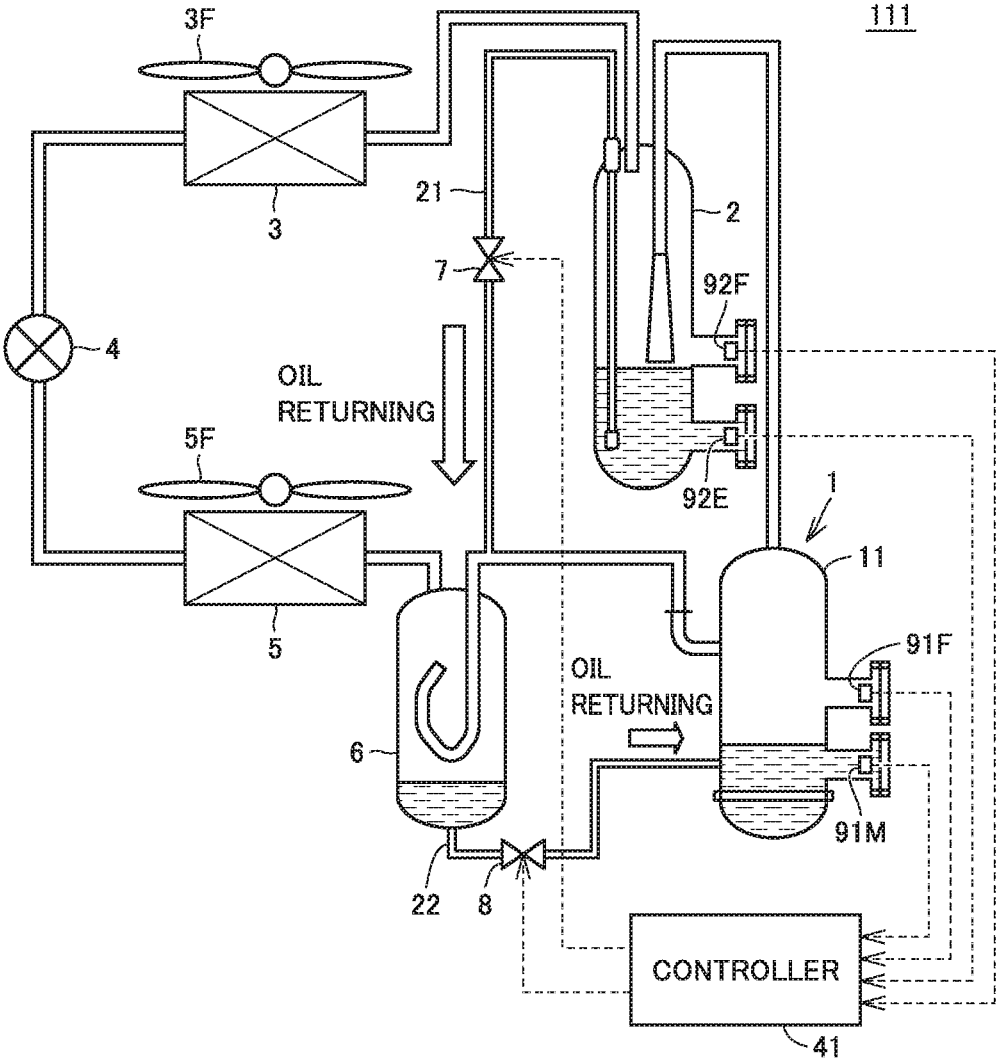
FIG. 25 is an entire configuration diagram of a refrigeration cycle apparatus according to a twelfth embodiment.

FIG. 25 is an entire configuration diagram of a refrigeration cycle apparatus according to the twelfth embodiment. A refrigeration cycle apparatus 111 shown in FIG. 25 includes a refrigerant circuit in which compressor 1, oil separator 2, condenser 3, expansion valve 4, evaporator 5, and accumulator 6 are connected in this order. Oil separator 2 and accumulator 6 are connected to compressor 1 via oil returning paths 21, 22. Electromagnetic valves 7, 8 are disposed on oil returning paths 21, 22 respectively. Self-heating sensor 91M is provided between the low shell portion and the motor position of compressor 1, and self-heating sensor 91F is provided at the motor position of compressor 1. Moreover, two upper and lower self-heating sensors 92F, 92E are attached at oil separator 2.

Figure 26:
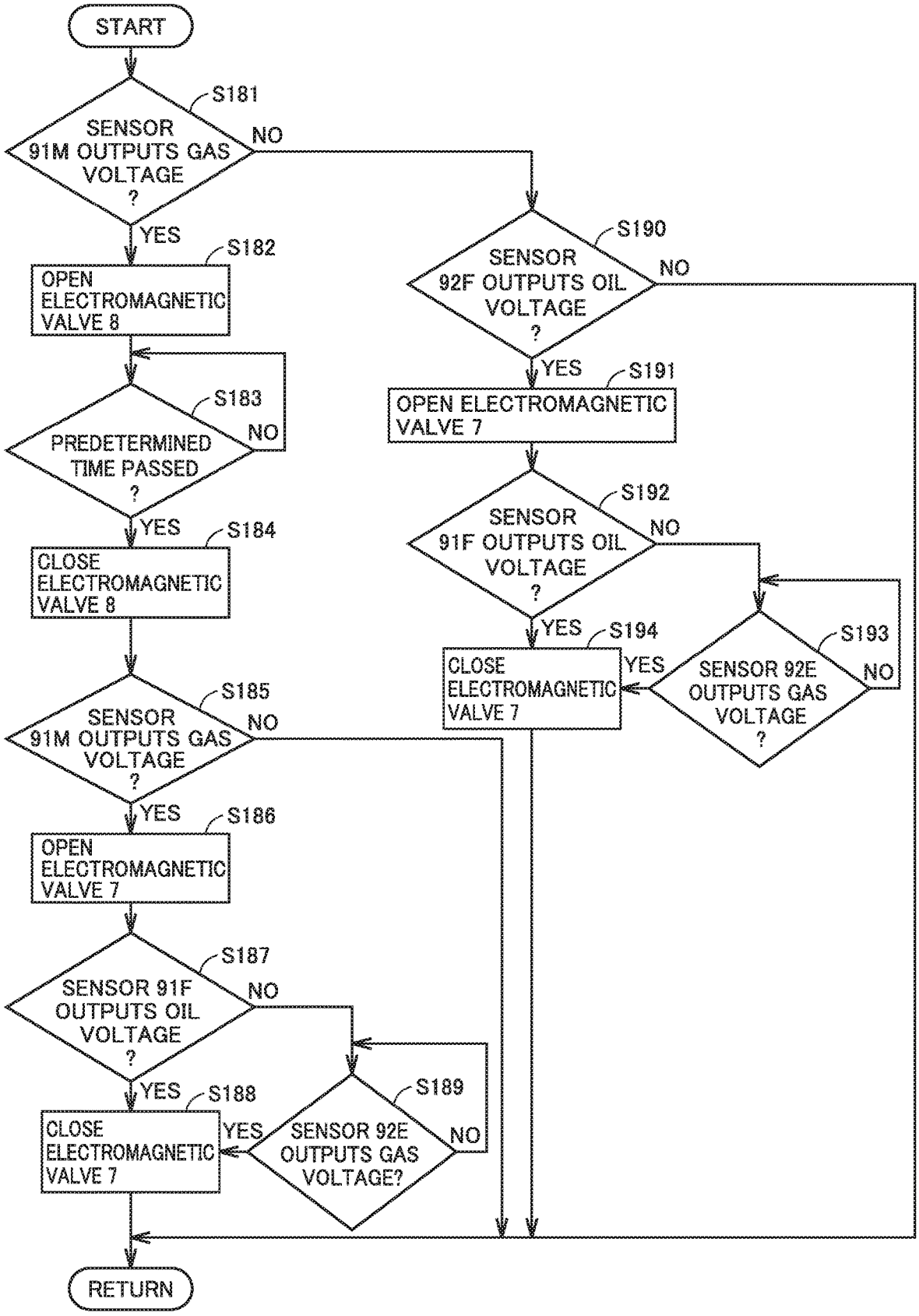
FIG. 26 is a flowchart for illustrating oil returning control in the twelfth embodiment.

FIG. 26 is a flowchart for illustrating oil returning control in the twelfth embodiment. With reference to FIG. 25 and FIG. 26, when the output of self-heating sensor 91M in compressor 1 indicates gas voltage Vsg (YES in S181), compressor 1 is in a state close to oil shortage. Then, controller 41 opens electromagnetic valve 8 on oil returning path 22, thereby returning the oil from accumulator 6 to compressor 1 (S182). After passage of a predetermined time (YES in S183), the refrigeration oil accumulated in accumulator 6 is released from accumulator 6. Then, controller 41 closes electromagnetic valve 8 (S184). When the output of sensor 91M indicates gas voltage Vsg at this point of time (YES in S185), the state close to the oil shortage of compressor 1 is still continued. In order to compensate for the insufficiency of the refrigeration oil, controller 41 opens electromagnetic valve 7 to start returning the oil from oil separator 2 to compressor 1 (S186). When the output of sensor 91F indicates oil voltage Vso (YES in S187) or when the output of sensor 92E indicates gas voltage Vsg (YES in S188), controller 41 closes electromagnetic valve 7 to end the oil returning (S189).

On the other hand, when the output of sensor 91M does not indicate gas voltage Vsg (NO in S181), compressor 1 is not in the oil shortage state. However, when the output of sensor 92F indicates oil voltage Vso (YES in S190), the oil level of oil separator 2 has been increased, so that in order to lower the oil level, controller 41 opens electromagnetic valve 7 to start returning the oil actively (S191). When the output of sensor 91F indicates oil voltage Vso (YES in S192) or when sensor 92E outputs the gas voltage and the amount of oil accumulated in oil separator 2 has been decreased (YES in S193), controller 41 closes electromagnetic valve 7 to end the oil returning (S194).

In the twelfth embodiment, decrease in the oil level in the compressor is detected by self-heating sensor 91M attached slightly above the lower portion in compressor 1 and the oil is returned from accumulator 6 and oil separator 2. On the other hand, self-heating sensor 92F is attached also to oil separator 2 to detect that the refrigeration oil has been accumulated in oil separator 2. Then, the refrigeration oil accumulated in oil separator 2 is returned actively. By performing the control in this way, the oil shortage state in compressor 1 can be prevented completely and the reliability of the refrigeration cycle apparatus can be secured.

Moreover, by determining the oil returning upper limit using self-heating sensor 91F attached to the motor position of compressor 1, the motor can be prevented from being soaked in the liquid, thereby avoiding the performance of compressor 1 from being decreased. Further, by determining to end the oil returning using lower sensor 92E in oil separator 2, only the refrigeration oil can be accurately returned to compressor 1, thereby preventing the refrigerator performance from being decreased due to a reduced refrigerant flow rate.

The twelfth embodiment is more excellent than the first embodiment in that: the volume efficiency of the compressor can be avoided from being decreased due to an excessive amount of the oil in compressor 1: oil shortage can be completely prevented; and the refrigerator performance can be prevented from being decreased due to the refrigerant being returned during the oil returning.

Finally, the refrigeration cycle apparatuses according to the respective embodiments will be summarized with reference to the main figures again. Among the embodiments, each of refrigeration cycle apparatuses 100 to 111 is a refrigeration cycle apparatus in which refrigerant circulates in an order of a compressor 1, an oil separator 2, a condenser 3, an expansion valve 4, an evaporator 5, and an accumulator 6. Refrigeration cycle apparatus 100 includes: an oil returning path 21 extending from oil separator 2 to compressor 1: an electromagnetic valve 7 provided on oil returning path 21: an oil returning path 22 extending from accumulator 6 to compressor 1: an electromagnetic valve 8 provided on oil returning path 22; and a controller 30 to 41 configured to control a degree of opening of electromagnetic valve 7 and a degree of opening of electromagnetic valve 8.

Refrigeration cycle apparatus 100 (or 103) shown in FIG. 1 (or FIG. 9) further includes a self-heating sensor 91E (or 91M) configured to detect an oil level position of refrigeration oil of compressor 1. Controller 30 (or 33) is configured to: increase the degree of opening of electromagnetic valve 8 when an output of self-heating sensor 91E (or 91M) indicates insufficiency of the refrigeration oil of compressor 1 at a first point of time; and increase the degree of opening of electromagnetic valve 7 when the output of self-heating sensor 91E (or 91M) indicates the insufficiency of the refrigeration oil of compressor 1 at a second point of time subsequent to the first point of time.

Since the self-heating sensor thus detects insufficiency of the refrigeration oil in compressor 1 precisely, oil shortage of compressor 1 can be prevented and performance of the refrigeration cycle apparatus can be prevented from being decreased due to an excess of oil.

Refrigeration cycle apparatus 107 (or 108) shown in FIG. 17 (or FIG. 19) further includes: a self-heating sensor 91E (or 91M) configured to detect that an oil level position of refrigeration oil of compressor 1 is below a first position; and a self-heating sensor 91F configured to detect that the oil level position is above a second position higher than the first position. Controller 37 (or 38) is configured to: increase the degree of opening of electromagnetic valve 8 when an output of self-heating sensor 91E (or 91M) indicates that the oil level position is below the first position at a first point of time; increase the degree of opening of electromagnetic valve 7 when the output of self-heating sensor 91E (or 91M) indicates that the oil level position is below the first position at a second point of time subsequent to the first point of time; and close electromagnetic valve 7 when an output of self-heating sensor 91F indicates that the oil level position is above the second position.

Since the self-heating sensors thus precisely detect that the refrigeration oil in compressor 1 is insufficient and that the oil has been sufficiently returned to compressor 1, oil shortage of compressor 1 can be prevented and performance of the refrigeration cycle apparatus can be prevented from being decreased due to an excess of oil.

Refrigeration cycle apparatus 101 shown in FIG. 5 further includes a self-heating sensor 92F configured to detect an oil level position of refrigeration oil of oil separator 2. Controller 31 is configured to increase the degree of opening of electromagnetic valve 7 when an output of self-heating sensor 92F indicates that an amount of the refrigeration oil in oil separator 2 is increased to be more than a reference amount.

Since the self-heating sensor can thus precisely detect that the amount of oil in oil separator 2 has become close to the upper limit, the performance of oil separator 2 can be prevented from being decreased, and the refrigeration oil can be prevented from being brought into the refrigerant circuit, thereby preventing oil shortage of compressor 1.

Refrigeration cycle apparatus 105 (or 106) shown in FIG. 13 (or FIG. 15) further includes: a self-heating sensor 92F configured to detect that an oil level position of refrigeration oil of oil separator 2 is above a first position; and a self-heating sensor 92E configured to detect that the oil level position is below a second position lower than the first position. Controller 35 (or 36) is configured to: increase the degree of opening of electromagnetic valve 7 when an output of self-heating sensor 92F indicates that the oil level position is above the first position at a first point of time; and close electromagnetic valve 7 when an output of self-heating sensor 92E indicates that the oil level position is below the second position at a second point of time subsequent to the first point of time.

Since the self-heating sensors thus precisely detect that the amount of oil in oil separator 2 has become close to the upper limit and that the refrigeration oil has been released from oil separator 2, pressure loss due to the oil being returned from oil separator 2 can be reduced as much as possible while preventing the performance of oil separator 2 from being decreased, whereby the efficiency of the refrigeration cycle apparatus can be prevented from being decreased.

Refrigeration cycle apparatus 107 (or 108) shown in FIG. 17 (or FIG. 19) further includes: a self-heating sensor 91E (or 91M) configured to detect that an oil level position of refrigeration oil of compressor 1 is below a first position; a self-heating sensor 91F configured to detect that the oil level position of the refrigeration oil of compressor 1 is above a second position higher than the first position: and a self-heating sensor 92F configured to detect that the oil level position of the refrigeration oil of oil separator 2 is above a third position. Controller 37 (or 38) is configured to: increase the degree of opening of electromagnetic valve 8 when an output of self-heating sensor 91E (or 91M) indicates that the oil level position is below the first position at a first point of time; and increase the degree of opening of electromagnetic valve 7 when the output of self-heating sensor 91E (or 91M) indicates that the oil level position is below the first position at a second point of time subsequent to the first point of time. Controller 37 (or 38) is configured to increase the degree of opening of electromagnetic valve 7 when an output of self-heating sensor 92F indicates that the oil level position of the refrigeration oil of oil separator 2 is above the third position at a third point of time. Controller 37 (or 38) is configured to close electromagnetic valve 7 when an output of self-heating sensor 91F indicates that the oil level position is above the second position.

The self-heating sensors thus precisely detect that the amount of oil in oil separator 2 has become close to the upper limit, detect oil shortage of compressor 1, and precisely detect that the amount of oil in compressor 1 has become close to the upper limit during the oil returning. Accordingly, while preventing the oil shortage in compressor 1, the oil returning can be stopped before loss occurs due to an excess of oil in compressor 1. Moreover, the oil separation performance of oil separator 2 can be maintained to prevent the refrigeration oil from being brought into the refrigerant circuit.

Refrigeration cycle apparatus 106 (or 109) shown in FIG. 15 (or FIG. 21) further includes: a self-heating sensor 91E (or 91M) configured to detect an oil level position of refrigeration oil of compressor 1; a self-heating sensor 92F configured to detect that the oil level position of the refrigeration oil of oil separator 2 is above a first position; and a self-heating sensor 92E configured to detect that the oil level position of the refrigeration oil of oil separator 2 is below a second position lower than the first position. Controller 36 (or 39) is configured to: increase the degree of opening of electromagnetic valve 8 when an output of self-heating sensor 91E (or 91M) indicates insufficiency of the refrigeration oil of compressor 1 at a first point of time; and increase the degree of opening of electromagnetic valve 7 when the output of self-heating sensor 91E (or 91M) indicates the insufficiency of the refrigeration oil of compressor 1 at a second point of time subsequent to the first point of time. Controller 36 (or 39) is configured to increase the degree of opening of electromagnetic valve 7 when an output of self-heating sensor 92F indicates that the oil level position of the refrigeration oil of oil separator 2 is above the first position at a third point of time. Controller 36 (or 39) is configured to close electromagnetic valve 7 when an output of self-heating sensor 92E indicates that the oil level position of the refrigeration oil of oil separator 2 is below the second position.

Thus, since the self-heating sensor precisely detects the oil shortage of compressor 1, the oil returning can be started before occurrence of oil shortage. Moreover, since the self-heating sensor precisely detects that the amount of oil in oil separator 2 has become close to the upper limit and that the refrigeration oil has been released from oil separator 2, pressure loss due to the oil being returned from oil separator 2 can be reduced as much as possible while preventing the performance of oil separator 2 from being decreased, whereby the efficiency of the refrigeration cycle apparatus can be prevented from being decreased.

Refrigeration cycle apparatus 110 (or 111) shown in FIG. 23 (or FIG. 25) further includes: a self-heating sensor 91E (or 91M) configured to detect that an oil level position of refrigeration oil of compressor 1 is below a first position: a self-heating sensor 91F configured to detect that the oil level position of the refrigeration oil of compressor 1 is above a second position higher than the first position: a self-heating sensor 92F configured to detect that an oil level position of the refrigeration oil of oil separator 2 is above a third position; and a self-heating sensor 92E configured to detect that the oil level position of the refrigeration oil of oil separator 2 is below a fourth position lower than the third position. Controller 40 (or 41) is configured to: increase the degree of opening of electromagnetic valve 8 when an output of self-heating sensor 91E (or 91M) indicates that the oil level position is below the first position at a first point of time: and increase the degree of opening of electromagnetic valve 7 when the output of self-heating sensor 91E (or 91M) indicates that the oil level position is below the first position at a second point of time subsequent to the first point of time. Controller 40 (or 41) is configured to increase the degree of opening of electromagnetic valve 7 when an output of self-heating sensor 92F indicates that the oil level position of the refrigeration oil of oil separator 2 is above the third position at a third point of time. Controller 40 (or 41) is configured to close electromagnetic valve 7 when an output of self-heating sensor 91F indicates that the oil level position is above the second position or when an output of self-heating sensor 92E indicates that the oil level position of the refrigeration oil of oil separator 2 is below the fourth position.

Thus, the self-heating sensors precisely detect the oil shortage of compressor 1 and precisely detect that the amount of oil in compressor 1 has become close to the upper limit during the oil returning. Accordingly, while preventing the oil shortage in compressor 1, the oil returning can be stopped before loss occurs due to an excess of oil in compressor 1. Moreover, since the self-heating sensors precisely detect that the amount of oil in oil separator 2 has become close to the upper limit and that the refrigeration oil has been released from oil separator 2, pressure loss due to the oil returning from oil separator 2 can be reduced as much as possible while preventing the performance of oil separator 2 from being decreased, whereby the efficiency of the refrigeration cycle apparatus can be prevented from being decreased.

As shown in FIG. 2 and the like, any one of self-heating sensors 91E, 91M, 91F, 92E, 92F described above has a heating element 25 configured to generate heat when supplied with electric power, heating element 25 having a resistance value that changes in response to a temperature change. By thus using the heating element in direct contact with the refrigeration oil to detect the level, it can be precisely detected that the oil level has reached a predetermined level.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

REFERENCE SIGNS LIST

1: compressor; 2: oil separator; 3: condenser; 4: expansion valve; 5: evaporator; 5F: evaporator fan; 6: accumulator; 7, 8: electromagnetic valve; 91E, 91F, 91M, 92E, 92F: sensor; 10: motor; 11: casing; 12: scroll compressor; 21, 22: oil returning path; 23, 24: electrode; 25: element; 30 to 41: controller.

The invention claimed is:

1. A refrigeration cycle apparatus in which refrigerant circulates in an order of a compressor, a first oil separator, a condenser, an expansion valve, an evaporator, and a second oil separator, the refrigeration cycle apparatus comprising:

a first oil return path extending from the first oil separator to the compressor;

a first valve provided on the first oil return path;

a second oil return path extending from the second oil separator to the compressor;

a second valve provided on the second oil return path;

a controller configured to control a degree of opening of the first valve and a degree of opening of the second valve; and a first detector configured to detect an oil level position of refrigeration oil of the compressor, wherein the controller is configured to open the second valve when an output of the first detector indicates insufficiency of the refrigeration oil of the compressor at a first point of time, and open the first valve when the output of the first detector indicates the insufficiency of the refrigeration oil of the compressor at a second point of time subsequent to the first point of time, wherein the refrigeration cycle apparatus further comprises:

a second detector configured to detect that the oil level position of the refrigeration oil of the first oil separator is above a first position; and a third detector configured to detect that the oil level position of the refrigeration oil of the first oil separator is below a second position lower than the first position, and wherein the controller is configured to open the first valve when the output of the first detector does not indicate insufficiency of the refrigeration oil of the compressor at the first point of time and when the output of the second detector indicates that the oil level position of the refrigeration oil of the first oil separator is above the first position at the first point of time, and close the first valve when an output of the third detector indicates that the oil level position of the refrigeration oil of the first oil separator is below the second position.

2. The refrigeration cycle apparatus according to claim 1, wherein the first detector has a first electrode, a second electrode, and a heating element configured to generate heat when supplied with electric power, the heating element having a resistance value that changes in response to a temperature change, and the heating element is disposed between the first electrode and the second electrode.

3. The refrigeration cycle apparatus according to claim 1, wherein each of the first detector, the second detector, and the third detector has a first electrode, a second electrode, and a heating element configured to generate heat when supplied with electric power, the heating element having a resistance value that changes in response to a temperature change, and the heating element is disposed between the first electrode and the second electrode.

* * * * *